US012302957B2

(12) United States Patent
Ward et al.

(10) Patent No.: US 12,302,957 B2
(45) Date of Patent: May 20, 2025

(54) METHOD AND APPARATUS TO CONVERT CLOTHING FOR SEXUAL INTEREST, BONDAGE AND POWER PLAY

(71) Applicant: LOOD, LLC, Mendham, NJ (US)

(72) Inventors: Deborah Ward, Mendham, NJ (US); Isaac Castañeda, Mendham, NJ (US); Diana Ponce-Cwiekalo, Valley Cottage, NY (US)

(73) Assignee: LOOD, LLC, Mendham, NJ (US)

( * ) Notice: Subject to any disclaimer, the term of this patent is extended or adjusted under 35 U.S.C. 154(b) by 0 days.

(21) Appl. No.: 17/501,124

(22) Filed: Oct. 14, 2021

(65) Prior Publication Data

US 2023/0119674 A1 Apr. 20, 2023

(51) Int. Cl.
*A41D 1/22* (2018.01)
*A41D 15/00* (2006.01)

(52) U.S. Cl.
CPC ..... *A41D 1/22* (2013.01); *A41D 15/00* (2013.01); *A41D 2300/322* (2013.01); *A41D 2300/33* (2013.01)

(58) Field of Classification Search
CPC . A41D 1/22; A41D 15/00; A41D 1/14; A41D 27/04
See application file for complete search history.

(56) References Cited

U.S. PATENT DOCUMENTS 31,876 A * 4/1861 DeForest ..... A41D 1/16 2/216
596,557 A * 1/1898 Van Orden ..... A41D 1/14 2/211

(Continued)

FOREIGN PATENT DOCUMENTS

KR 950000210 Y1 1/1995
KR 100889123 B1 * 3/2009 ..... A41B 1/14

(Continued)

OTHER PUBLICATIONS www.amazon.com/ACSUSS-harness-Bandage-Lingere Acsuss women hollow body chest harness belt bandage body cage sexy lingere bra with garter skirt Date First Available: Jul. 5, 2021 (Year: 2021).*

(Continued)

*Primary Examiner* — Alissa L Hoey
(74) *Attorney, Agent, or Firm* — Calderone McKay, LLC

(57) ABSTRACT

A method and apparatus to convert clothing for sexual interest, bondage and power play. The clothing includes convertible dresses, convertible jacket or convertible skirt. An outer layer of the clothing is formed of a rigid layer to serve as a restraining element in bondage or power play for sexual interest. An under base layer can be formed of a flexible material to protect the skin from undesired friction from the outer layer. Fastening and release mechanisms are used for coupling the under base layer to the outer layer and removal of the under base layer from the outer layer. The fastening and release mechanisms can be used to expeditiously detach the under base layer from the outer layer without the need to manipulate the outer layer. The under base layer can be decoupled from the outer layer transforming the garment into sexual paraphernalia, such as a bondage cage.

6 Claims, 33 Drawing Sheets

(56) References Cited

U.S. PATENT DOCUMENTS 744,882 A * 11/1903 Stratton ..... A41D 1/14 2/48
828,345 A * 8/1906 Sykes ..... A41D 1/14 2/211
837,738 A * 12/1906 Schneider ..... A41D 1/14 2/73
999,132 A * 7/1911 Suddick ..... A41D 1/14 2/211
1,037,514 A * 9/1912 O'Connor et al. ..... A41D 1/14 2/211
1,084,970 A * 1/1914 Shokopsky ..... A41D 1/22 2/74
1,195,738 A * 8/1916 Rose ..... A41D 27/02 2/97
1,364,276 A * 1/1921 Hannaford ..... A41D 1/14 2/48
1,521,228 A * 12/1924 Clamage ..... A41D 1/22 2/48
1,924,433 A * 8/1933 Harpster ..... A41B 11/12 D2/993
2,415,996 A * 2/1947 Eilenberg ..... A41D 27/04 2/97
2,528,639 A * 11/1950 Clayton ..... A41D 1/16 D2/729
2,784,413 A * 3/1957 Brett ..... A41B 9/10 2/216
2,991,480 A * 7/1961 Campbell ..... A41D 1/16 2/216
3,147,491 A * 9/1964 Fisch ..... A41D 3/06 2/86
3,463,162 A * 8/1969 Heggie ..... A41B 11/12 450/95
3,506,015 A * 4/1970 Stacy ..... A41C 1/00 450/122
4,149,275 A * 4/1979 Sanchez ..... A41D 1/06 2/269
4,715,068 A * 12/1987 Jacobson ..... A41D 27/04 2/912
5,038,410 A * 8/1991 Grilliot ..... A41D 27/04 2/81
5,535,453 A * 7/1996 Howard ..... A44B 18/00 2/269
6,240,560 B1 * 6/2001 DeCaro ..... A41B 9/002 2/67
6,308,334 B1 * 10/2001 Maas ..... A41D 15/00 2/74
6,317,893 B1 * 11/2001 Walton ..... A41D 27/04 2/82
6,393,622 B1 * 5/2002 Rice ..... A41F 11/00 2/409
7,520,794 B1 * 4/2009 Johnson ..... A41B 1/22 2/109
7,735,155 B2 * 6/2010 Kerkhoff ..... A41D 1/06 2/48
8,966,667 B2 * 3/2015 Peck ..... A41D 31/185 2/227
9,027,164 B2 * 5/2015 Seiler ..... A41D 1/22 2/54
9,149,082 B2 * 10/2015 Canady ..... A41F 19/00
9,380,818 B2 * 7/2016 Tippett ..... A41D 1/14
9,572,381 B2 * 2/2017 Maryea ..... A41D 1/14
10,595,576 B1 * 3/2020 Hopkins ..... A41F 17/00
10,631,579 B2 * 4/2020 Hadley ..... A44B 17/0041
11,134,733 B2 * 10/2021 Miller ..... A41D 1/06
2004/0177427 A1 * 9/2004 Pedrick ..... A41F 7/00 2/82
2006/0162040 A1 * 7/2006 Lee ..... A41D 1/14 2/7
2007/0101481 A1 * 5/2007 Stokesbary ..... A41D 7/005 2/211
2009/0093189 A1 * 4/2009 Frey ..... A41C 3/00 2/69
2010/0107302 A1 * 5/2010 Ross ..... A41B 9/06 2/113
2011/0297719 A1 * 12/2011 Sabbah ..... A41D 1/14 2/211
2012/0084899 A1 * 4/2012 Yanagisawa ..... A41F 19/00 2/69
2014/0162530 A1 * 6/2014 Wallace ..... A41C 3/08 450/32
2015/0040281 A1 2/2015 Gbadamosi
2016/0157578 A1 * 6/2016 Ricci ..... A45D 8/14 132/200
2017/0006939 A1 * 1/2017 Moctezuma ..... A41D 1/14
2017/0231289 A1 8/2017 Storch
2018/0255853 A1 * 9/2018 Spathas ..... B65D 33/00
2018/0255883 A1 9/2018 Brandt et al.
2018/0368501 A1 * 12/2018 Freeman ..... A41D 1/02
2019/0125012 A1 5/2019 White, Jr.
2021/0015185 A1 1/2021 Fotabong
2021/0015186 A1 1/2021 Winegan
2021/0071335 A1 * 3/2021 Luna ..... D06C 29/00
2023/0025919 A1 * 1/2023 Reuben ..... A41D 27/04

FOREIGN PATENT DOCUMENTS

KR 20100013036 U * 12/2010 ..... A41B 9/10
WO WO-2017193020 A1 * 11/2017 ..... A41D 1/084

OTHER PUBLICATIONS www.fanplusfriend.com Title: Gothic steampunk Crinoline Midi Skirt Bonded Midi Skirt Pannier Cage Skirt Hoop Birdcage Petticoat Date: May 2017 (see reviews) (Year: 2017).*
Knstrct.com/fashion-blog/2012/07/08/the-cage-skirt Article/Blog Title: The Cage Skirt Publication Date: Jul. 8, 2012 (Year: 2012).*

* cited by examiner

METHOD AND APPARATUS TO CONVERT CLOTHING FOR SEXUAL INTEREST, BONDAGE AND POWER PLAY

BACKGROUND OF THE INVENTION

Field of the Invention

The present invention generally relates to sex play and in particular to conversion of clothing for sexual interest, bondage and power play.

Description of Related Art

Clothing fashioned to include sex play paraphernalia has been described. U.S. Patent 2017/0231289 describes clothing including a platform used to hold sexual paraphernalia.

It is desirable to provide clothing which can be worn in social settings and is expeditiously convertible for sexual interest and play.

SUMMARY OF THE INVENTION

The present invention relates to a method and apparatus to convert clothing for sexual interest, bondage and power play. In example embodiments, the apparatus to convert clothing includes convertible dresses, a convertible jacket or a convertible skirt.

The apparatus to convert clothing can comprise two independent layers of different textures. An outer layer is formed of a material to serve as a restraining element in bondage or power play for sexual interest. An under base layer can be formed of a flexible material. The outer layer can be formed of a semi-flexible material which is less flexible than the under base layer. The under base layer protects the skin from undesired friction from the outer layer. The under base layer can be made with elegant materials to allow the user to wear the pieces in social situations. The bondage capability of the convertible clothing may not be apparent to outside observers.

In one embodiment, the outer layer can be formed of a mesh of material with sufficient tensile strength to serve as a restraining element for use in bondage play. Alternatively, the outer layer can be formed of leather. Robust fastening and release mechanisms can be strategically positioned in areas of the outer layer where some movement of the user is desired. In one embodiment, the outer layer includes one or more rings strategically positioned to facilitate bondage.

The under base layer can be formed of soft materials including for example polyester, cotton, polyester and cotton combinations, elastane synthetic fiber, cotton and elastane synthetic fiber combinations and silk jersey.

The apparatus to convert clothing can include fastening and release mechanisms for coupling the under base layer to the outer layer and removal of the under base layer from the outer layer. The fastening and release mechanisms can be used to expeditiously detach the under base layer from the outer layer without the need to manipulate the outer layer. The under base layer can be decoupled from the outer layer transforming the garment into sexual paraphernalia, such as a bondage cage. The elegance achieved with the combination of layers and the ease of decoupling allows for a seamless conversion of the clothing garment.

The invention will be more fully described by reference to the following drawings.

DETAILED DESCRIPTION

Figure 1A:
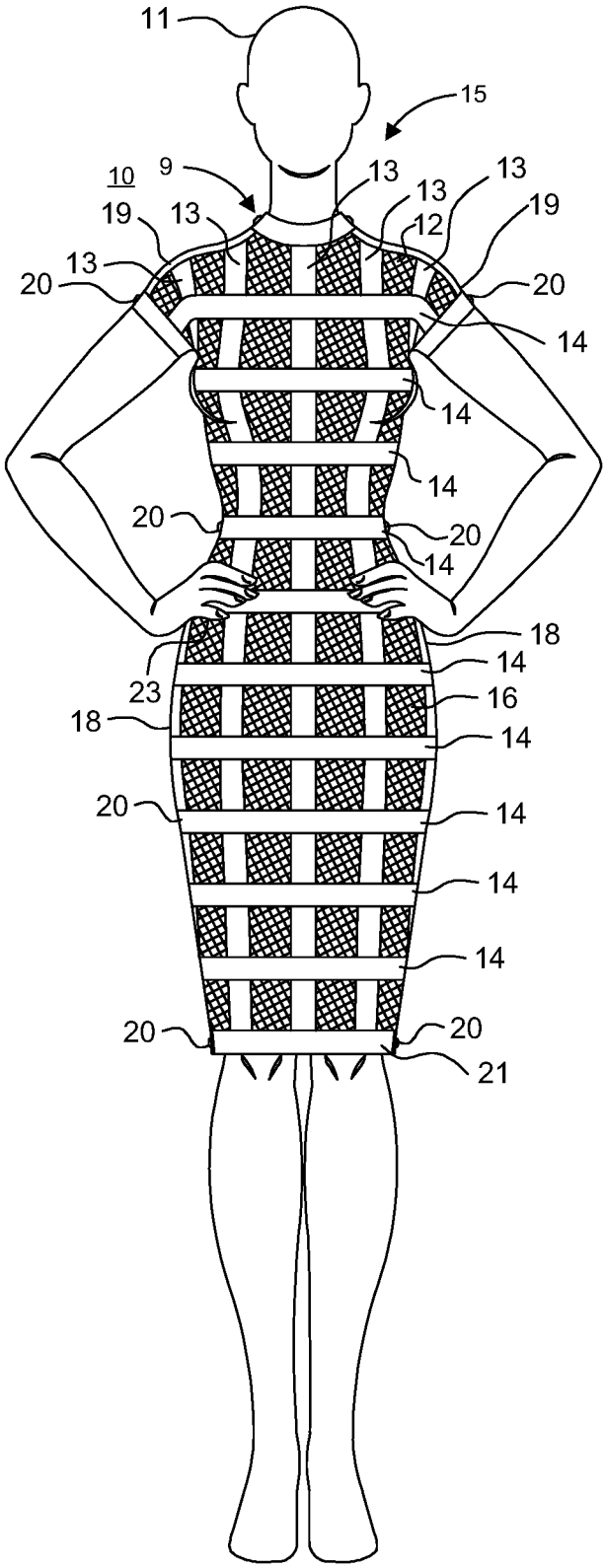
FIG. 1A is a schematic diagram of a front view of a convertible dress in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIGS. 1A-1K illustrate an embodiment of clothing 9 of convertible dress 10 in accordance with the teachings of the present invention. Outer layer 12 is formed of a plurality of vertical straps 13 and a plurality of horizontal straps 14. Each of vertical straps 13 can be coupled or integral with the plurality of horizontal straps 14 and each of horizontal straps 14 can be coupled or integral with vertical straps 13. Under base layer 16 is positioned beneath outer layer 12.

Outer layer 12 can be formed of a semi-flexible material. Suitable materials for outer layer 12 include a mesh of material with sufficient tensile strength to serve as a restraining element. In one embodiment, outer layer 12 can be formed of leather. Alternatively, outer layer 12 can be formed of poly elastane.

Figure 1B:
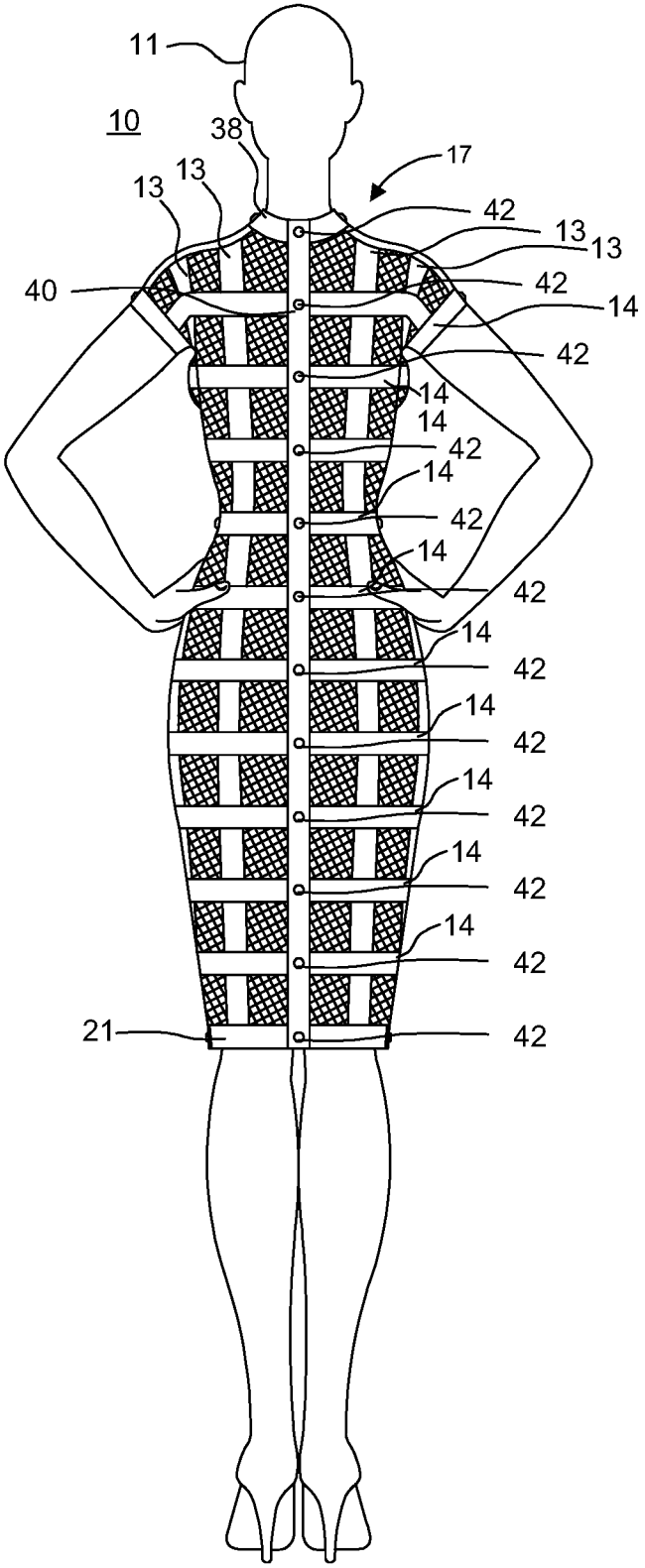
FIG. 1B is a schematic diagram of a rear view of the convertible dress.

Under base layer 16 can be formed of a flexible material. Under base layer 16 can be formed of flexible or soft fabric materials. Suitable materials for under base layer 16 include polyester, cotton, polyester and cotton combinations, elastane synthetic fiber, cotton and elastane synthetic fiber combinations and silk jersey. Elastane synthetic fiber can include spandex including LYCRA® as manufactured by Dupont. Under base layer 16 protects skin of user 11 from undesired friction of outer layer 12. Outer layer 12 can be formed of a material which is less flexible than the material of under base layer 16. FIG. 1A illustrates front 15 of convertible dress 10. FIG. 1B illustrates rear 17 of convertible dress 10.

Fastening and release mechanisms 20 are positioned along sides 18 and top 19 of convertible dress 10. Fastening and release mechanisms 20 releasably couple under base layer 16 to outer layer 12. Fastening and release mechanisms 20 can be used to expeditiously detach under base layer 16 from 12 outer layer without the need for the user to manipulate outer layer 12. Fastening and release mechanism 20 can be positioned at hem 21 and waist 23 of convertible dress 10.

Figure 1C:
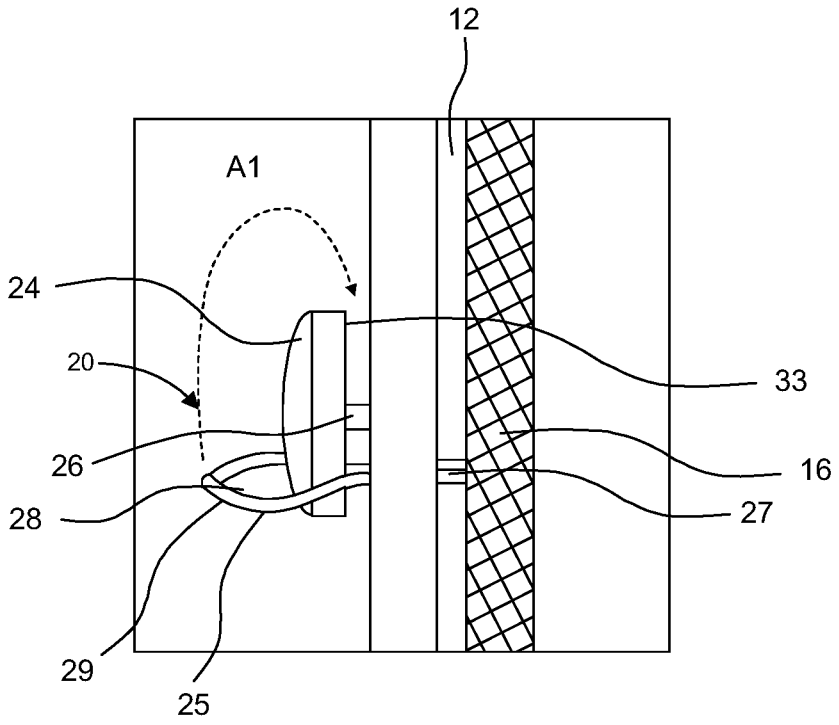
FIG. 1C is a schematic diagram of an embodiment of a dress fastening and release mechanism including a button at a waist and hem used with the convertible dress.

FIG. 1C illustrates an embodiment of fastening and release mechanism 20. Fastening and release mechanism 20 includes button 24 and coupling member 25. Stem 26 of button 24 is coupled to outer layer 12. End 27 of coupling member 25 is coupled to under base layer 16. Coupling member 25 includes loop 28 at front end 29. Loop 28 can be positioned under outer layer 12. Loop 28 is moved in a direction of arrow A1 to be received over button 24. Loop 28 engages rear 33 of button 24 for coupling under base layer 16 to outer layer 12. Loop 28 is disengaged from button 24 to decouple under base layer 16 from outer layer 12. Suitable materials for button 24 include plastic, metal or wood. Suitable materials for coupling member 25 include elastic and flexible plastic. For example the flexible plastic material can be a thermoplastic material.

Figure 1D:
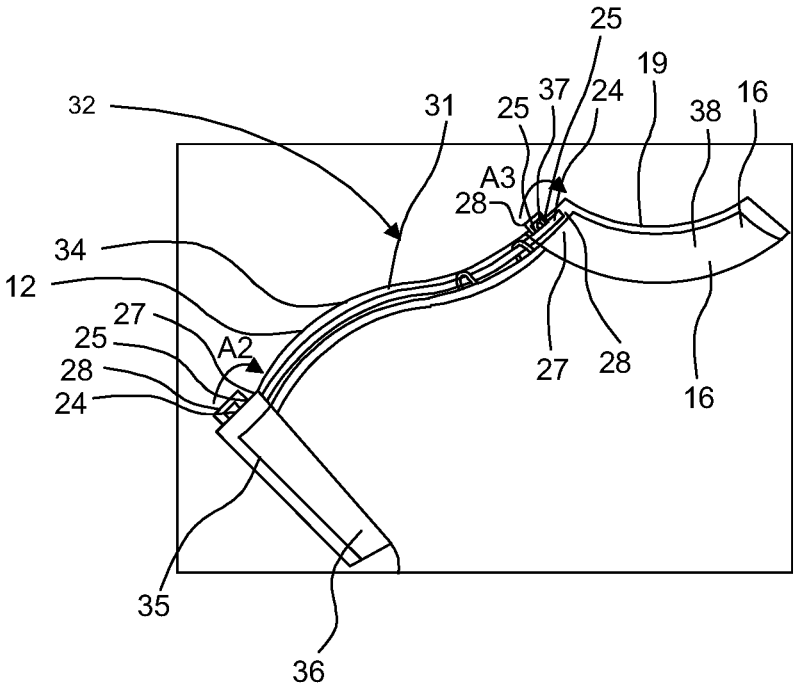
FIG. 1D is a schematic diagram of an embodiment of a dress fastening and release mechanism used with the convertible dress.

Fastening and release mechanism 20 can be combined with shoulder fastening and release mechanism 32 as shown in FIG. 1D. Shoulder fastening and release mechanism 32 is positioned at shoulder 31 of top 19 of convertible dress 10. Flexible rod 34 of shoulder fastening and release mechanism 32 extends between end 35 adjacent to sleeve 36 and end 37 adjacent to collar 38. End 27 of a coupling member 25 is coupled to inner base layer 16 beneath end 35 of flexible rod 34. End 27 of a coupling member 25 is coupled to inner base layer 16 beneath end 37 of flexible rod 34. Coupling member 25 extends from end 35 of flexible rod 32 to engage with button 24 positioned on sleeve 36. Coupling member 25 extends from end 37 of flexible rod 32 to engage with button 24 positioned on collar 38. Respective loops 28 are moved in the directions of arrows A2 and A3 to be received over respective buttons 24. Loop 28 engages rear 33 of button 24 for coupling under base layer 18 to outer layer 12 at shoulder 31. Loop 28 is disengaged from button 24 to decouple under base layer from outer layer 12 at shoulder 31.

Figure 1E:
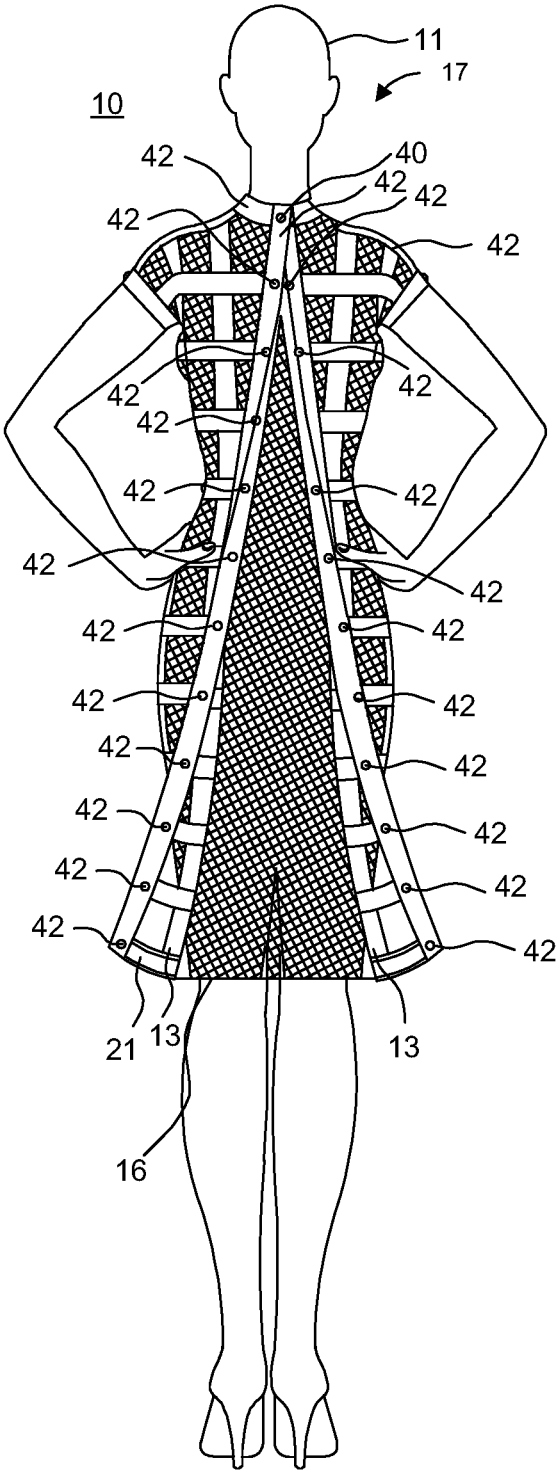
FIG. 1E is a schematic diagram of a rear view of the convertible dress during opening of an outer layer and opening of an under dress base layer.

Referring to FIG. 1B and FIGS. 1E-1I, closure placket 40 can be formed at rear 17 of convertible dress 10. Closure placket 40 is coupled to the plurality of horizontal straps 14. Closure placket 40 is used for opening and closing a center seam of outer layer 12. Closure placket 40 extends between collar 38 and hem 21 at the center seam of outer layer 12. In a closed position, closure placket 40 attaches adjacent horizontal straps 14 to one another. Closure placket 40 can include a plurality of snaps 42 to attach closure placket 40 to the plurality of horizontal straps 14. Zipper closure 44 extends between collar 38 and hem 21 of under base layer 16. Zipper closure 44 is used for opening and closing under base layer 16. Zipper closure 44 extends beneath closure placket 40. Zipper closure 44 can be hidden by closure placket 40. As shown in FIG. 1E, zipper closure 44 can be unzipped to open under base layer 16 between hem 21 and waist 23.

Figure 1F:
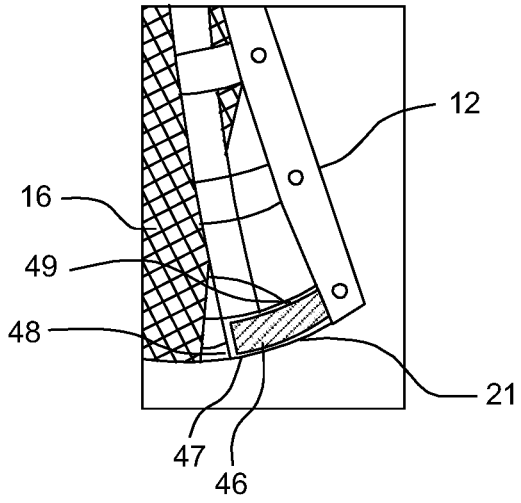
FIG. 1F is a schematic diagram of strap for holding a bottom of the convertible dress open, the strap being in a closed position.
Figure 1G:
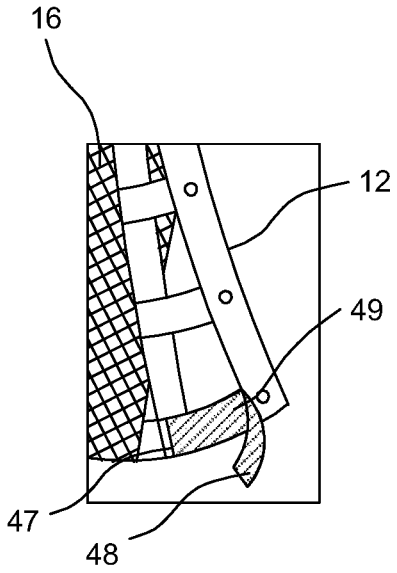
FIG. 1G is a schematic diagram of strap for holding a bottom of the convertible dress open, the strap being in an open position.
Figure 1H:
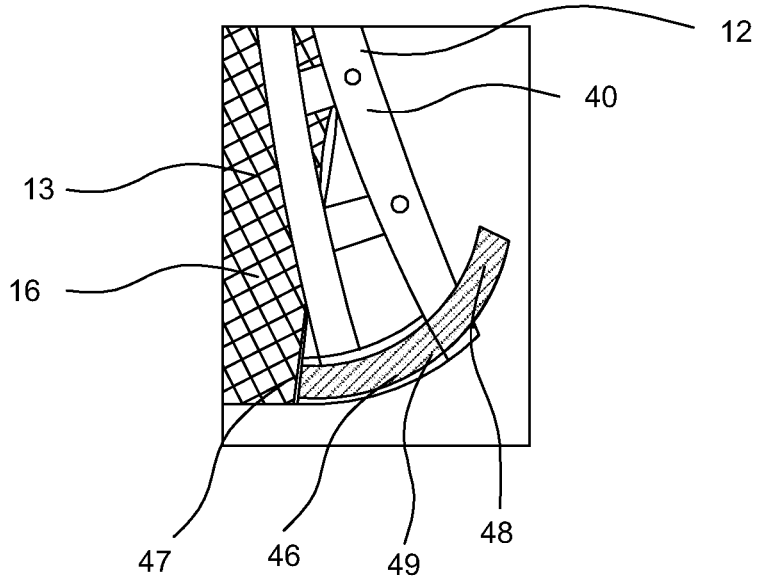
FIG. 1H is a schematic diagram of strap for holding a bottom of the convertible dress open, the strap being in an open position and being moved toward a vertical strap.
Figure 1I:
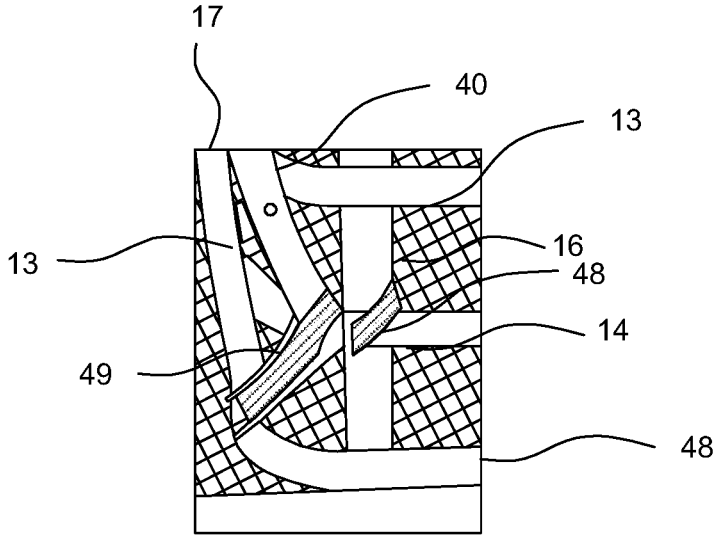
FIG. 1I is a schematic diagram of side view of the strap for holding a bottom of the convertible dress open, the strap being positioned around the vertical strap of the outer layer.

Referring to FIGS. 1H-1I, straps 46 can be positioned at hem 21. Straps 46 can be formed of a hook and loop material such as VELCRO. Straps 46 can be attached to outer base layer 12 at hem 21. Strap 46 includes end portion 47 and end portion 48. End portion 48 of strap 46 is attached to base portion 49 of strap 46 in a closed position as shown in FIG. 1F. In the closed position, strap 46 can be hidden by hem 21. End portion 48 of strap 46 is released from base portion 49 of strap 46 in an open position, as shown in FIG. 1G. End portion 48 is moved around closure placket 40 as shown in FIG. 1H. End portion 48 wraps around vertical strap 13 and end portion 48 can connect to base portion 49 as shown in FIG. 1I. Straps 46 in the open position can be used to hold outer layer 12 open when closure placket 40 is unsnapped from waist 23.

Figure 1J:
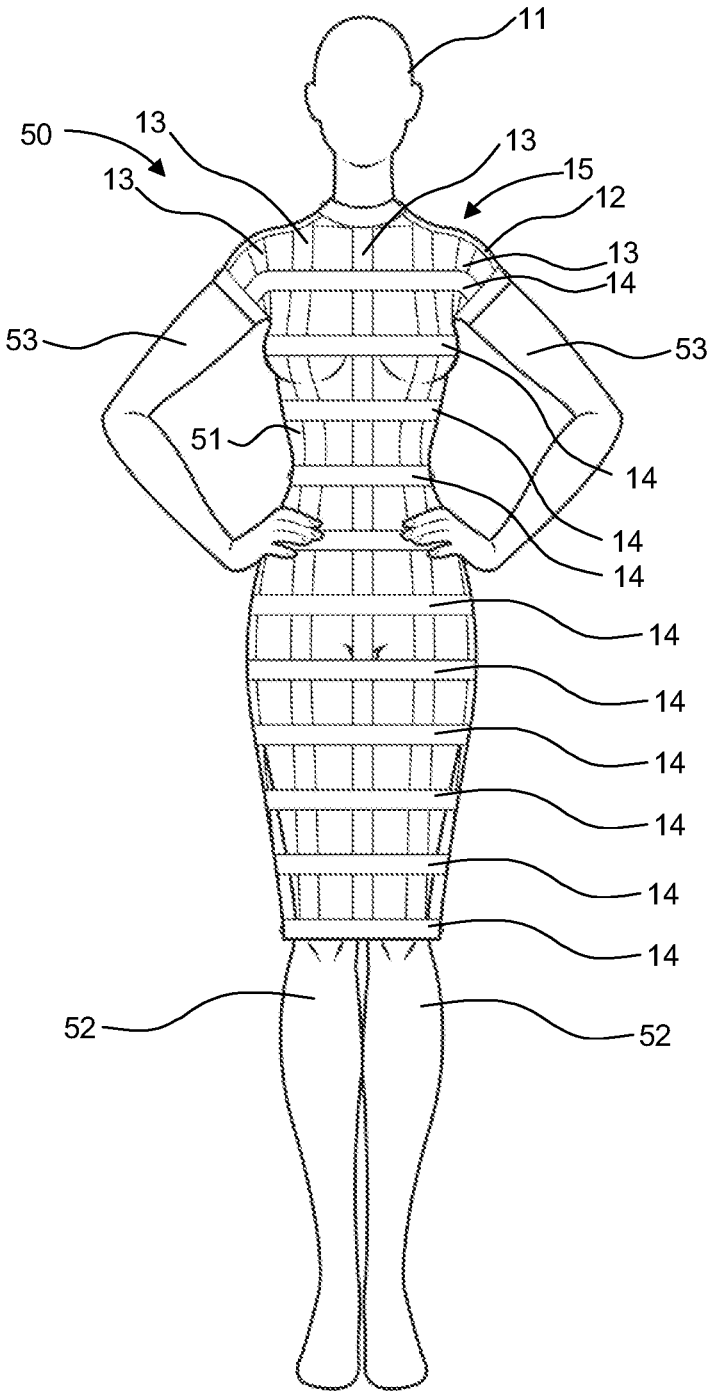
FIG. 1J is a schematic diagram of a front view of the convertible dress upon removal of an under dress base layer.
Figure 1K:
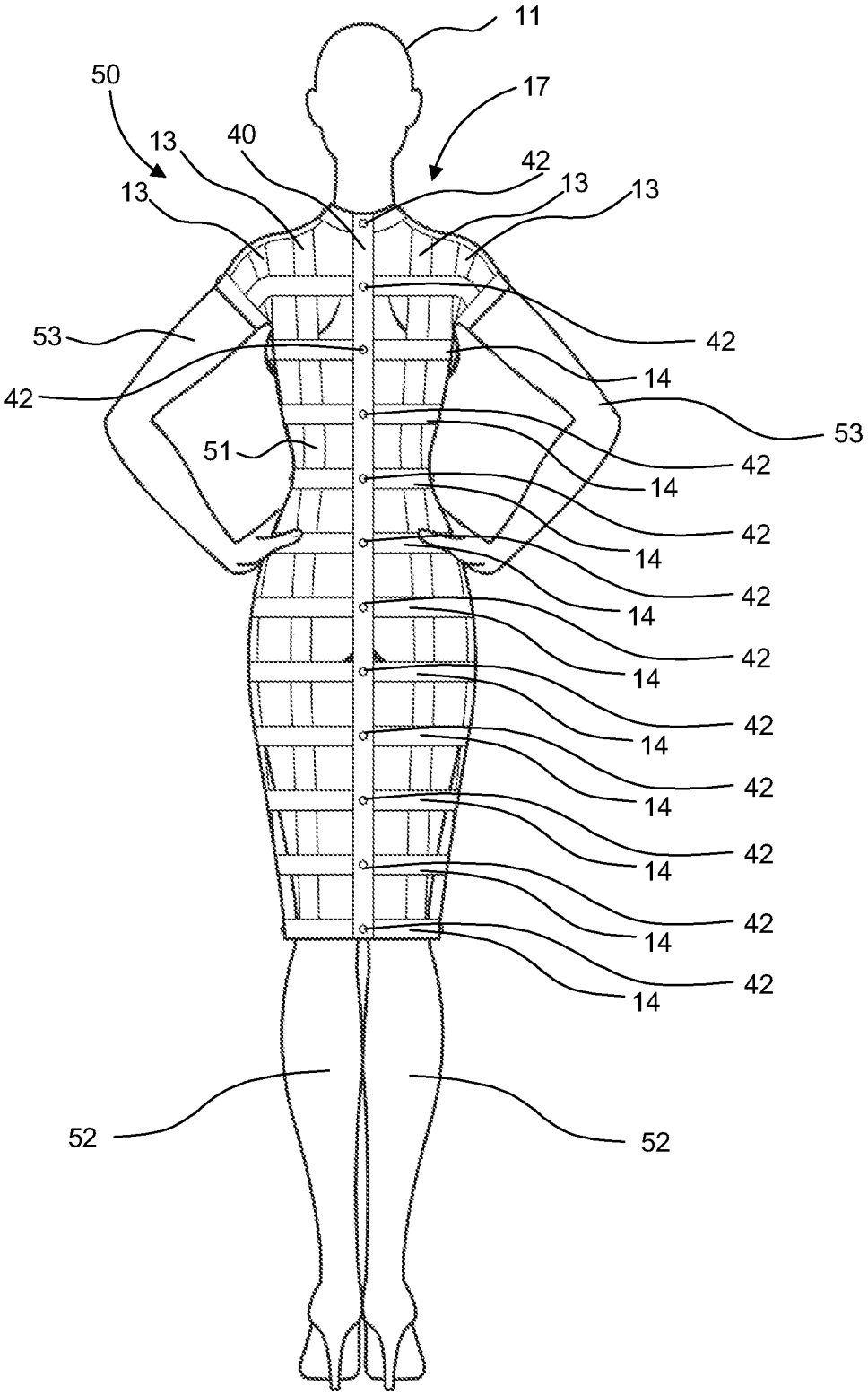
FIG. 1K is a schematic diagram of a rear view of the convertible dress upon removal of an under dress base layer.

FIGS. 1J and 1K illustrate outer layer 12 after removal of under base layer 14. Outer layer 12 forms cage 50 for retaining torso 51, arms 53 and legs 52 in a predetermined position. The position can be determined for sexual interest or bondage and power play.

FIGS. 2A-2L illustrate an embodiment of clothing 9 of convertible dress 100 in accordance with the teachings of the present invention. Outer layer 112 is formed of a plurality of vertical straps 113 and a plurality of diagonal straps 114. Each of vertical straps 113 can be formed of one or more sections which are coupled or integral with each other and one or more sections of diagonal straps 114. One or more diagonal straps 114 can be coupled or integral with one or more diagonal straps 114. Under base layer 116 is positioned beneath outer layer 112.

Outer layer 112 can be formed of rigid material. Suitable materials for outer layer 112 include a mesh of material with sufficient tensile strength to serve as a restraining element. In one embodiment, outer layer 112 can be formed of leather. Alternatively, outer layer 112 can be formed of poly elastane.

Under base layer 116 can be formed of a flexible material. Under base layer 116 can be formed of flexible or soft fabric materials. Suitable materials for under base layer 116 include polyester, cotton, polyester and cotton combinations, elastane synthetic fiber, cotton and elastane synthetic fiber combinations and silk jersey. Elastane synthetic fiber can include spandex including LYCRA® as manufactured by Dupont. Under base layer 116 protects skin of user 11 from undesired friction of outer layer 112.

Figure 2A:
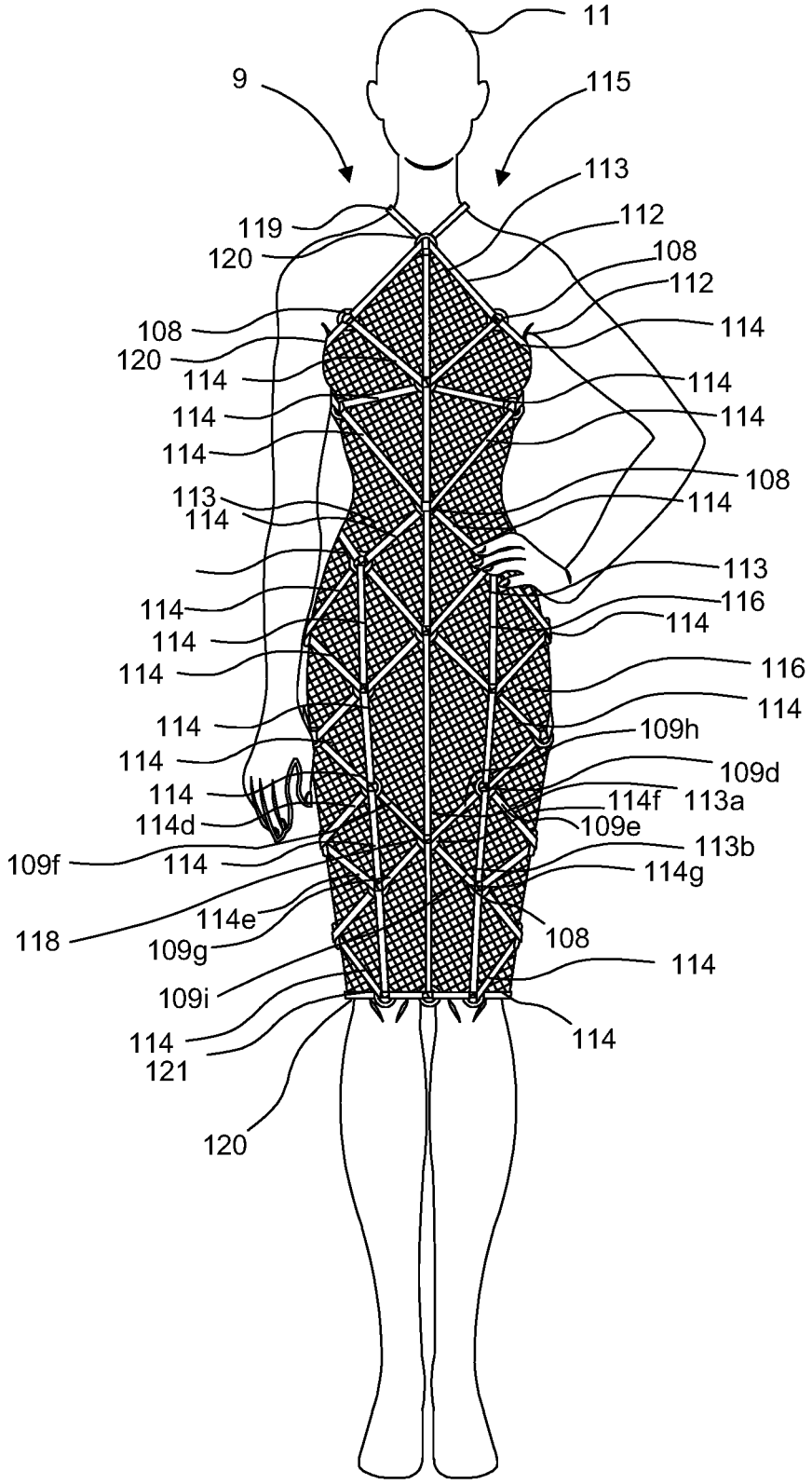
FIG. 2A is a schematic diagram of a front view of a convertible dress in accordance with the teachings of the present invention.
Figure 2B:
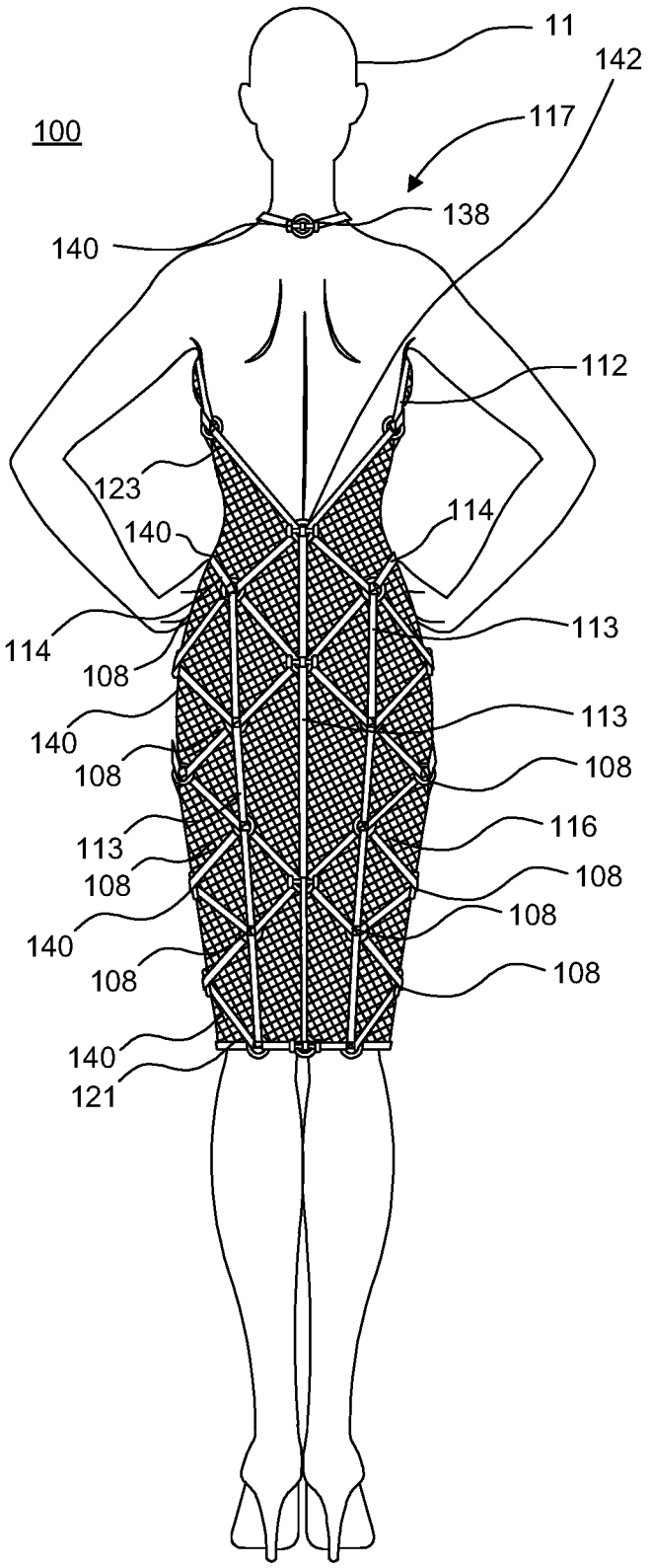
FIG. 2B is a schematic diagram of a rear view of the convertible dress shown in FIG. 2A.
Figure 2C:
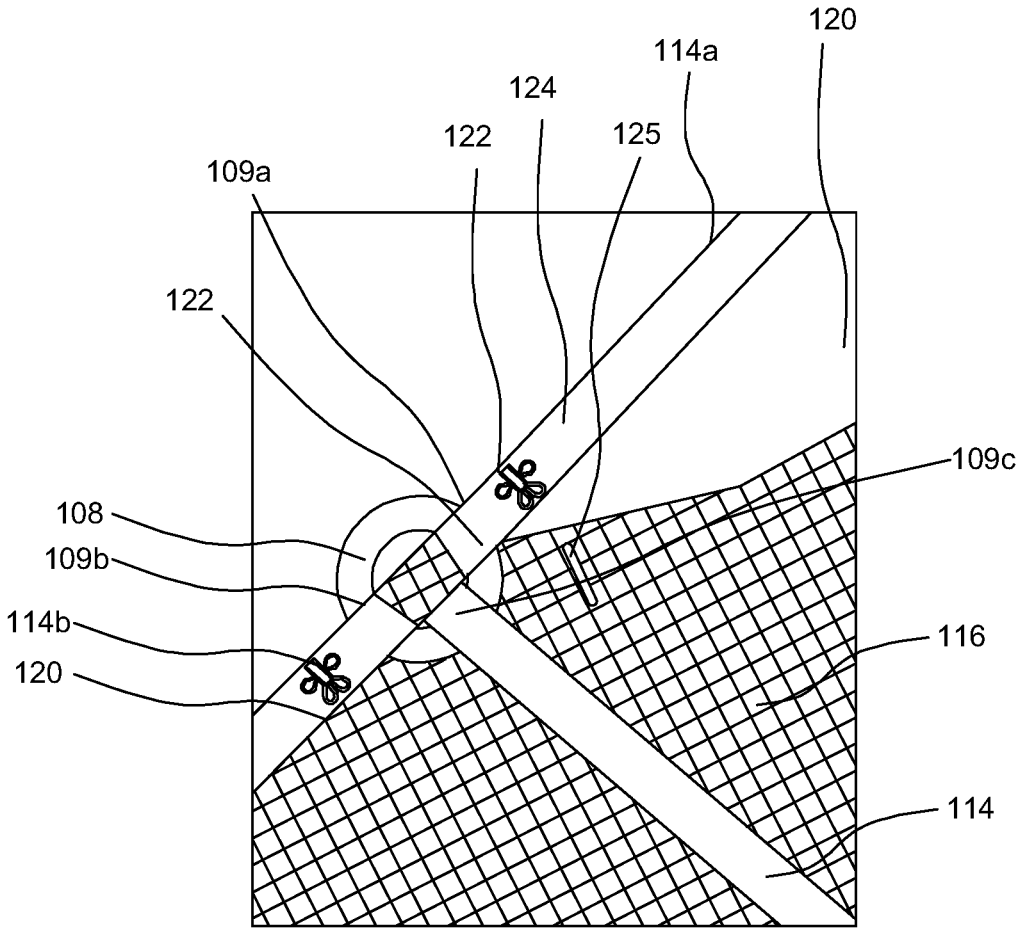
FIG. 2C is a schematic diagram of an embodiment of a dress fastening and release mechanism including a hook and eye coupling at a neckline used with the convertible dress shown in FIG. 2A.

FIG. 2A illustrates front 115 of convertible dress 100. FIG. 2B illustrates rear 117 of convertible dress 100. In one embodiment, a plurality of diagonal straps 114*a*-114*c* can be coupled to one another using ring 108 as shown in FIG. 2C. Each of diagonal straps 114*a*-114*c* include a respective end 109*a*-109*c* which is coupled to ring 108. Referring to FIG. 2A, a plurality of vertical straps 113*a*-113*b* and a plurality of diagonal straps 114*d*-114*g* can be coupled to one another using ring 108. Each of vertical straps 113*a*-113*b* and diagonal straps 114*a*-114*c* include a respective end 109*d*-109*i* which is coupled to ring 108. Fastening and release mechanisms 120 are positioned along sides 118 and neckline 119 of convertible dress 100. Fastening and release mechanisms 120 releasably couple under base layer 116 to outer layer 112. Fastening and release mechanisms 120 can be used to expeditiously detach under base layer 116 from outer layer 112 without the need for the user to manipulate outer layer 112. Fastening and release mechanism 120 can be positioned at hem 121 and waist 123 of convertible dress 100.

FIG. 2C illustrates an embodiment of fastening and release mechanism 120. Fastening and release mechanism 20 includes loop 122, hook coupling member 124 and eye coupling member 125. Loop 122 is coupled to underside 126 of diagonal straps 114. For example, loop 122 can be sewn to diagonal strap 114. Eye coupling member 124 is attached to diagonal strap 114 of outer layer 112 and hook coupling member 125 attached to under base layer 116 for coupling under base layer 116 to outer layer 112. Hook coupling member 124 is disengaged from eye coupling member 125 to decouple under base layer 116 from outer layer 112. Suitable materials for hook coupling member 124 and eye coupling member 125 include plastic or metal.

Figure 2D:
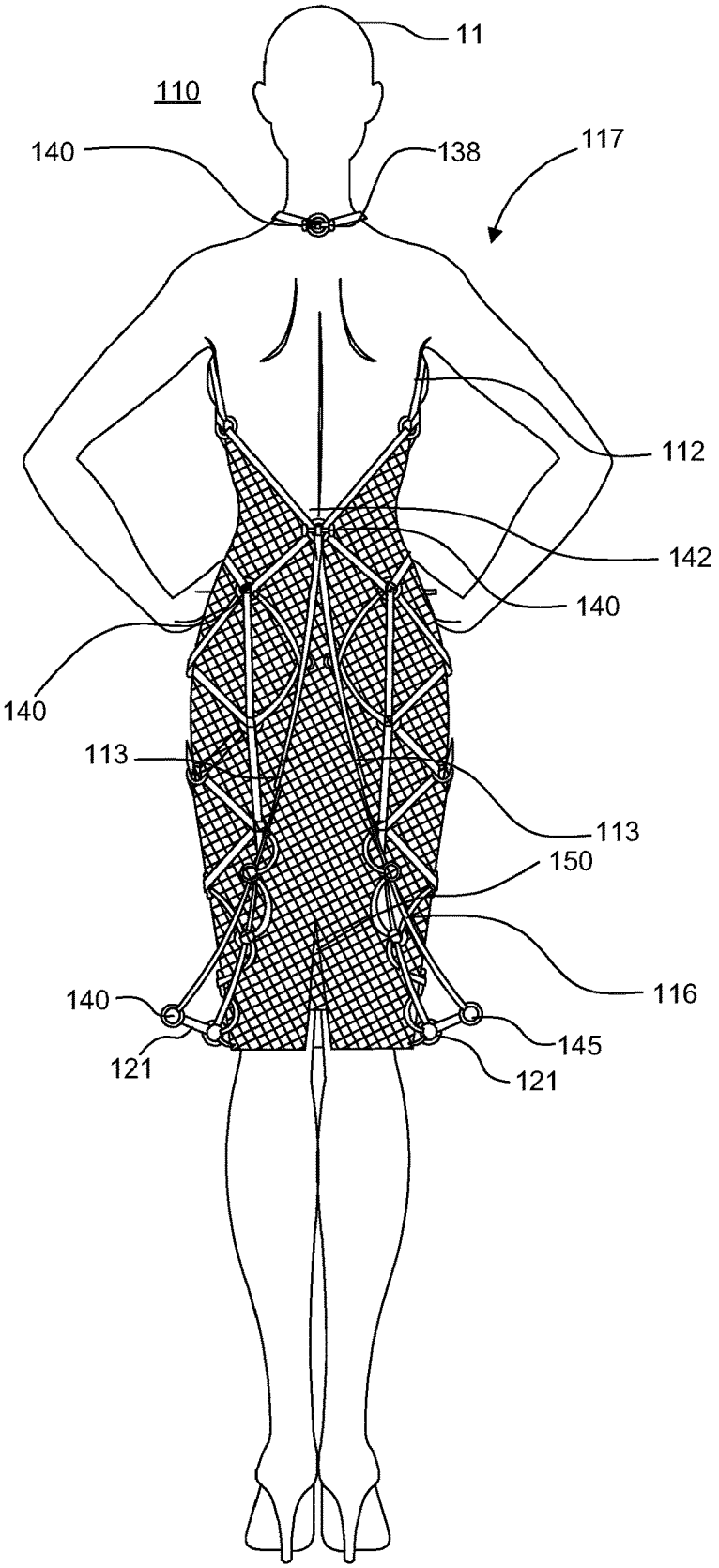
FIG. 2D is a schematic diagram of a rear view of the convertible dress shown in FIG. 2A in an open position.
Figure 2E:
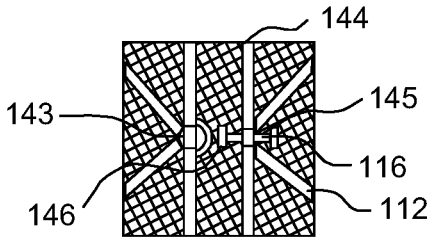
FIG. 2E is a schematic diagram of a closure device including a O-ring and a toggle closure device in an open position.
Figure 2F:
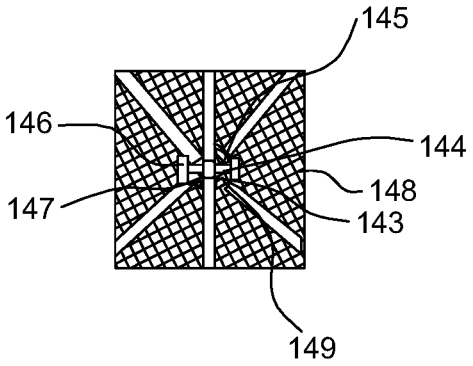
FIG. 2F is a schematic diagram of a closure device including a O-ring and a toggle closure device in a closed position.

Referring to FIGS. 2D-2F, closure devices 140 can be formed at rear 117 of convertible dress 100. Closure devices 140 can be positioned at collar 138 and along vertical strap 113 of outer layer 112 located at center 142. Closure devices 140 can be moved between an open and closed position. Closure devices 140 can be formed of ring opening 143, ring 144 and toggle 145. Ring 144 can be an O-ring. In an open position as shown in FIG. 2E, toggle 145 is removed from ring opening 143 to open outer layer 112. In a closed position as shown in FIG. 2F, toggle 145 is received in ring opening 143 to attach outer layer 112. End 146 of toggle 145 is received in ring opening 143. End 146 of toggle 145 extends over side 147 of ring 144. End 148 of toggle 145 extends over side 149 of ring 144.

Referring to FIG. 2D, zipper closure 150 extends underneath vertical strap 113 located at center 142. Zipper closure 150 can be hidden by vertical strap 113. Zipper closure 150 extends between waist 123 and hem 121 of under base layer 116. Zipper closure 150 is used for opening and closing under base layer 116. Zipper closure 150 can be unzipped to open under base layer 116 between hem 121 and waist 123

Figure 2G:
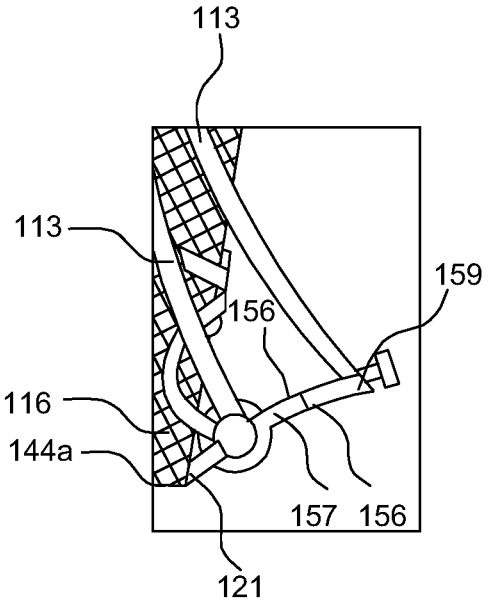
FIG. 2G is a schematic diagram of strap for holding a bottom of the convertible dress open, the strap being in a closed position.
Figure 2H:
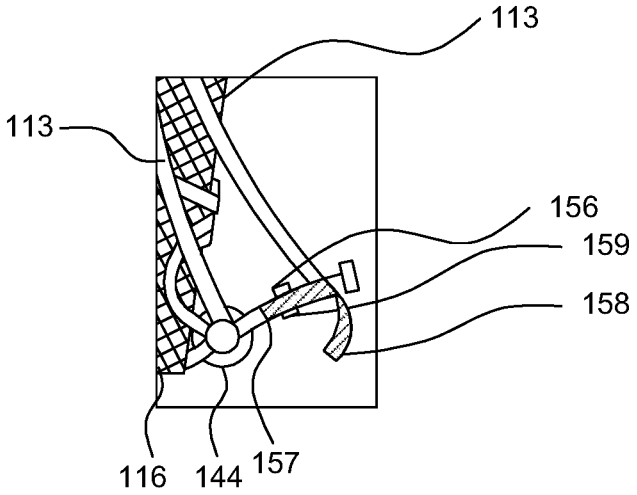
FIG. 2H is a schematic diagram of strap for holding a bottom of the convertible dress open, the strap being in an open position.
Figure 2I:
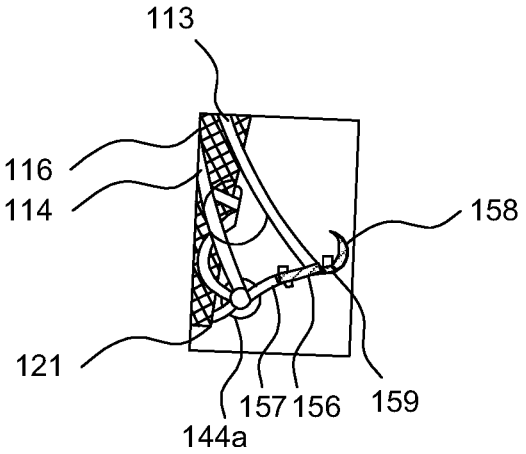
FIG. 2I is a schematic diagram of strap for holding a bottom of the convertible dress open, the strap being in an open position and being moved toward a O-ring.
Figure 2J:
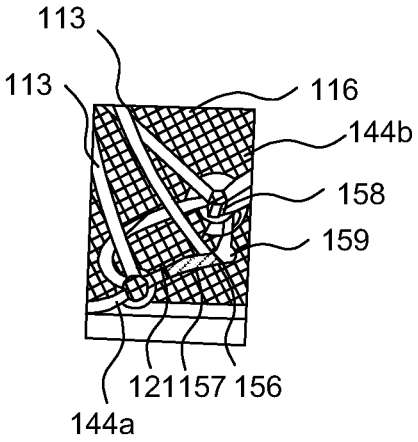
FIG. 2J is a schematic diagram of a side view of strap for holding a bottom of the convertible dress open, the strap being positioned around the vertical strap of the outer layer and through the O-ring.

Referring to FIGS. 2G and 2H, straps 156 can be positioned at hem 121. Straps 156 can be formed of a hook and loop material such as VELCRO. Strap 156 includes end portion 157 and end portion 158. End portion 157 of strap 156 can be attached to ring 144*a* of outer layer 112. End portion 158 of strap 156 is attached to base portion 159 of strap 156 in a closed position as shown in FIG. 2G. In the closed position, strap 156 is hidden. End portion 158 of strap 156 is released from base portion 159 of strap 156 in an open position, as shown in FIG. 2H. End portion 158 is moved around vertical strap 113 as shown in FIG. 2I. End portion 158 wraps around vertical strap 113. End portion 158 extends through ring 144*b* and end portion 158 connects to base portion 159 as shown in FIG. 2J. Straps 156 in the open position can be used to hold outer layer 112 open when closure device 140 is opened.

Figure 2K:
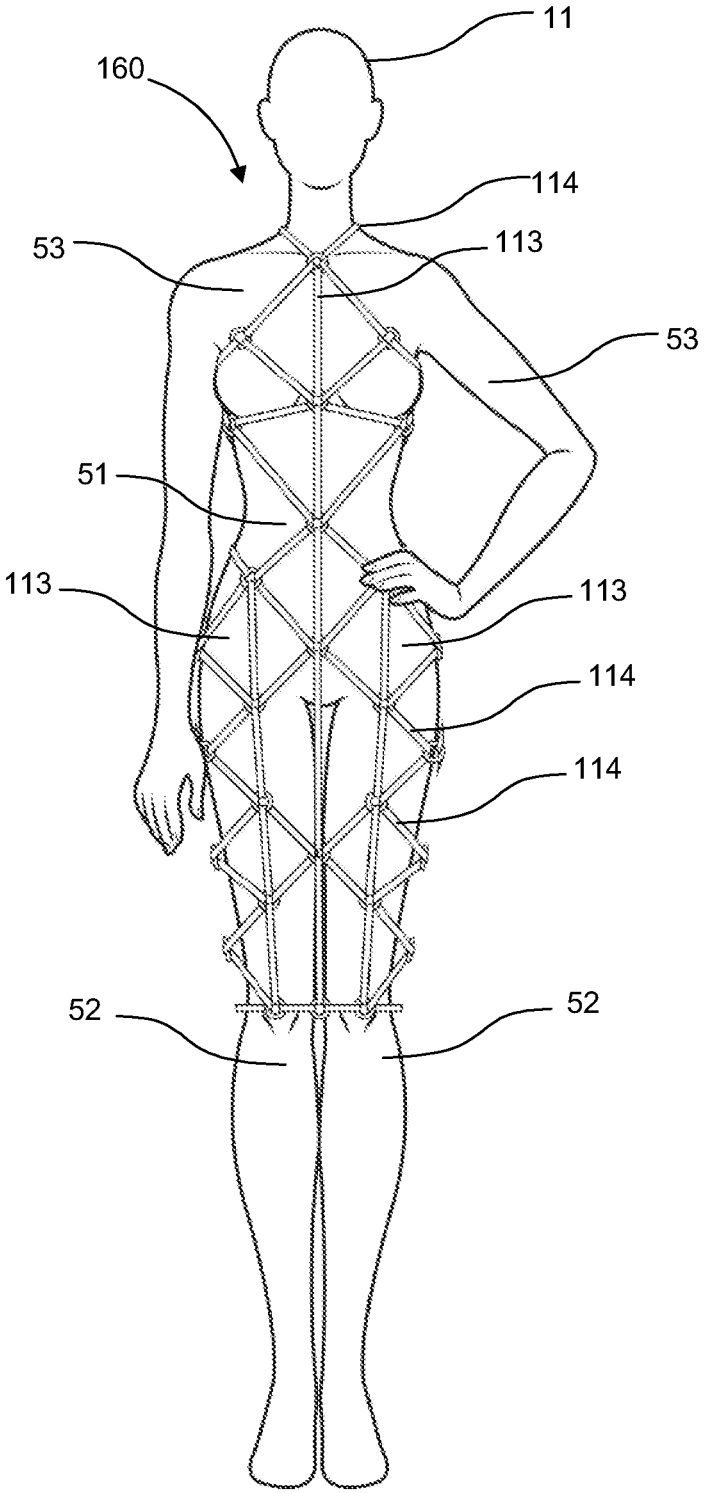
FIG. 2K is a schematic diagram of a front view of the convertible dress shown in FIG. 2A upon removal of an under dress base layer.
Figure 2L:
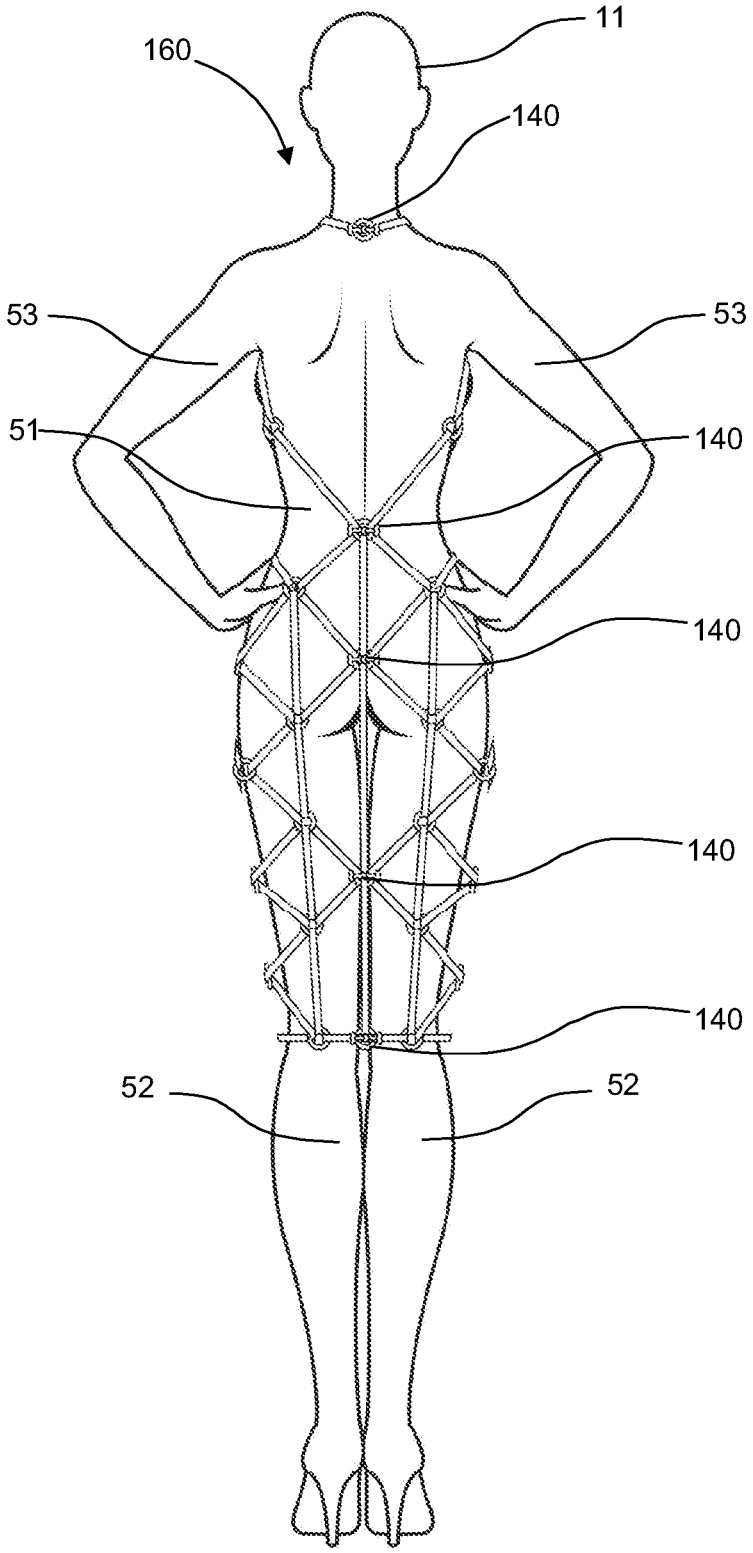
FIG. 2L is a schematic diagram of a rear view of the convertible dress shown in FIG. 2A upon removal of an under dress base layer.

FIGS. 2K and 2L illustrate outer layer 112 after removal of under base layer 116. Outer layer 112 forms cage 160 for retaining torso 51, arms 53 and legs 52 in a predetermined position. The position can be determined for sexual interest or bondage.

During operation, convertible dress 100 is converted between the combination of outer layer 112 and under base layer 116 into outer layer 112 forming cage 160. Under base layer 116 is disengaged from outer layer 112 by disengaging hook coupling member 124 from eye coupling member 125 of each of fastening and release mechanisms 120 and moving closure devices 140 at rear 117 of convertible dress 110 to an open position. Rear 117 of convertible dress 110 can opened partially or to waist 112 to remove under base layer 116 from outer layer 112.

FIGS. 3A-3J illustrate an embodiment of clothing 9 of convertible jacket 200 in accordance with the teachings of the present invention. Outer layer 212 is formed of one or more horizontal straps 205, one or more vertical straps 213 and one or more diagonal straps 214. Each of vertical straps 213 can be formed of one or more sections which are coupled or integral with each other and one or more sections of horizontal straps 205 and diagonal straps 214. One or more diagonal straps 214 can be coupled or integral with one or more diagonal straps 214. Under base layer 216 is positioned beneath outer layer 212.

Outer layer 212 can be formed of rigid material. Suitable materials for outer layer 212 include a mesh of material with sufficient tensile strength to serve as a restraining element. In one embodiment, outer layer 212 can be formed of leather. Alternatively, outer layer 112 can be formed of poly elastane.

Under base layer 216 can be formed of a flexible material. Under base layer 216 can be formed of flexible or soft fabric materials. Suitable materials for under base layer 116 include polyester, cotton, polyester and cotton combinations, elastane synthetic fiber, cotton and elastane synthetic fiber combinations and silk jersey. Elastane synthetic fiber can include spandex including LYCRA® as manufactured by Dupont. Under base layer 216 protects skin of user 11 from undesired friction of outer layer 212.

Figure 3A:
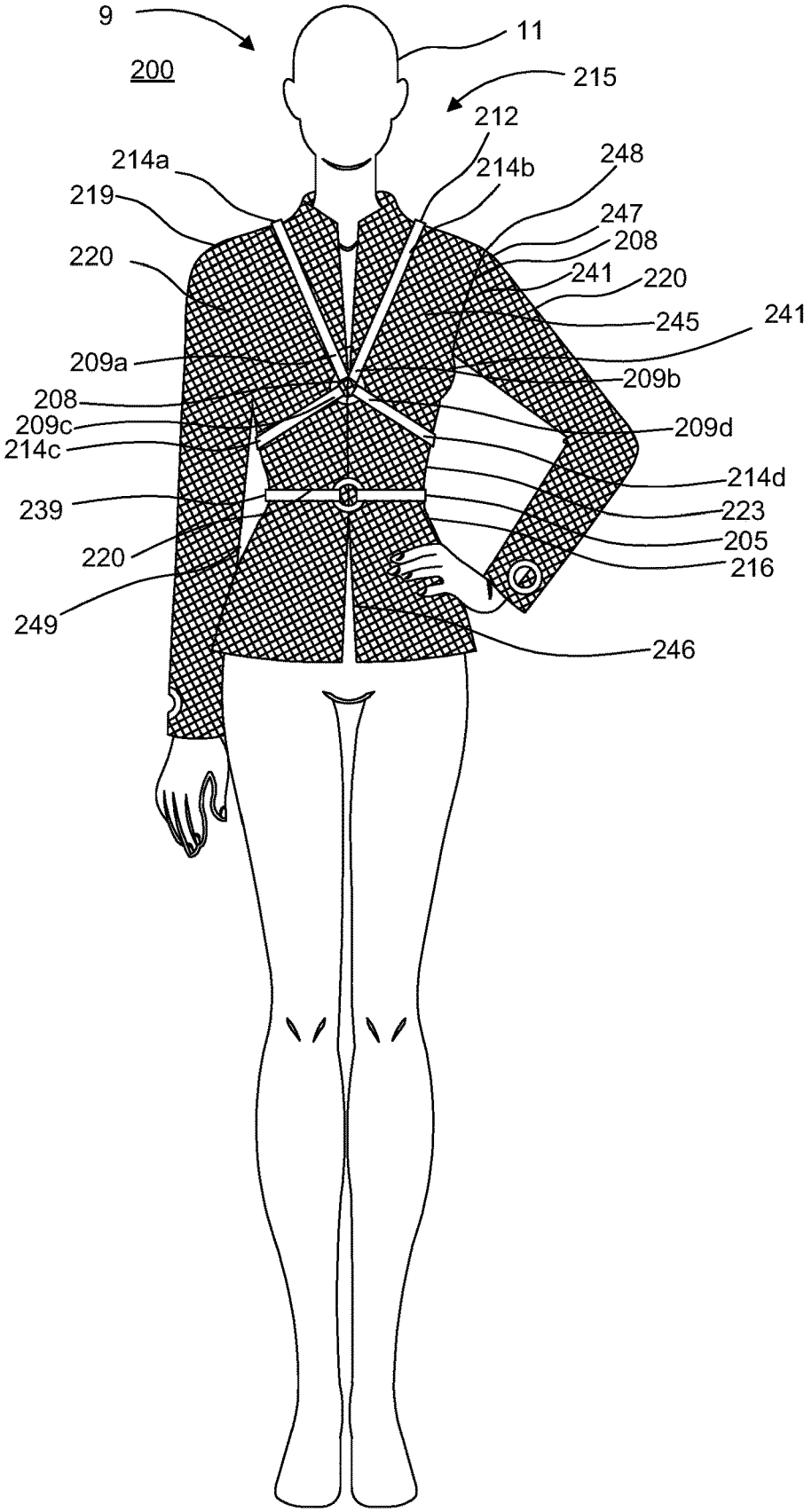
FIG. 3A is a schematic diagram of a front view of a convertible jacket in accordance with the teachings of the present invention.
Figure 3B:
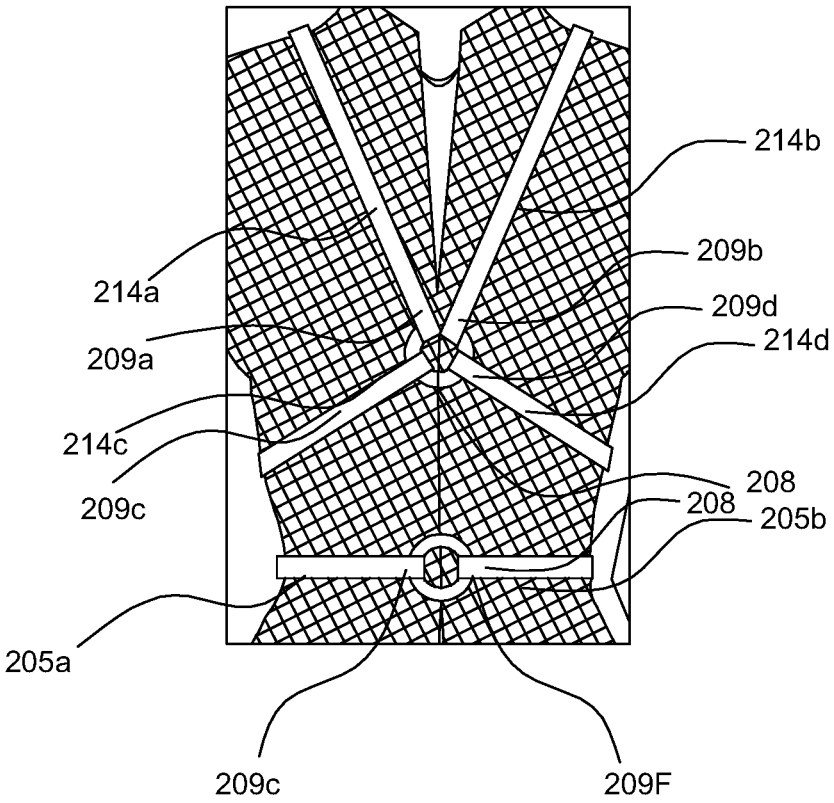
FIG. 3B is a schematic diagram of attachment of straps at the front of the convertible jacket using an O-ring.

FIG. 3A illustrates front 215 of convertible jacket 200. In one embodiment, a plurality of diagonal straps 214*a*-214*d* can be coupled to one another using ring 208 as shown in FIG. 3B. Each of diagonal straps 214*a*-214*d* include a respective loop 209*a*-209*d* which extends around ring 208. Ring 208 can be an O-ring. Each of horizontal straps 205*a*-205*b* include a respective loop 209*e*-209*f* which extends around ring 208.

Figure 3C:
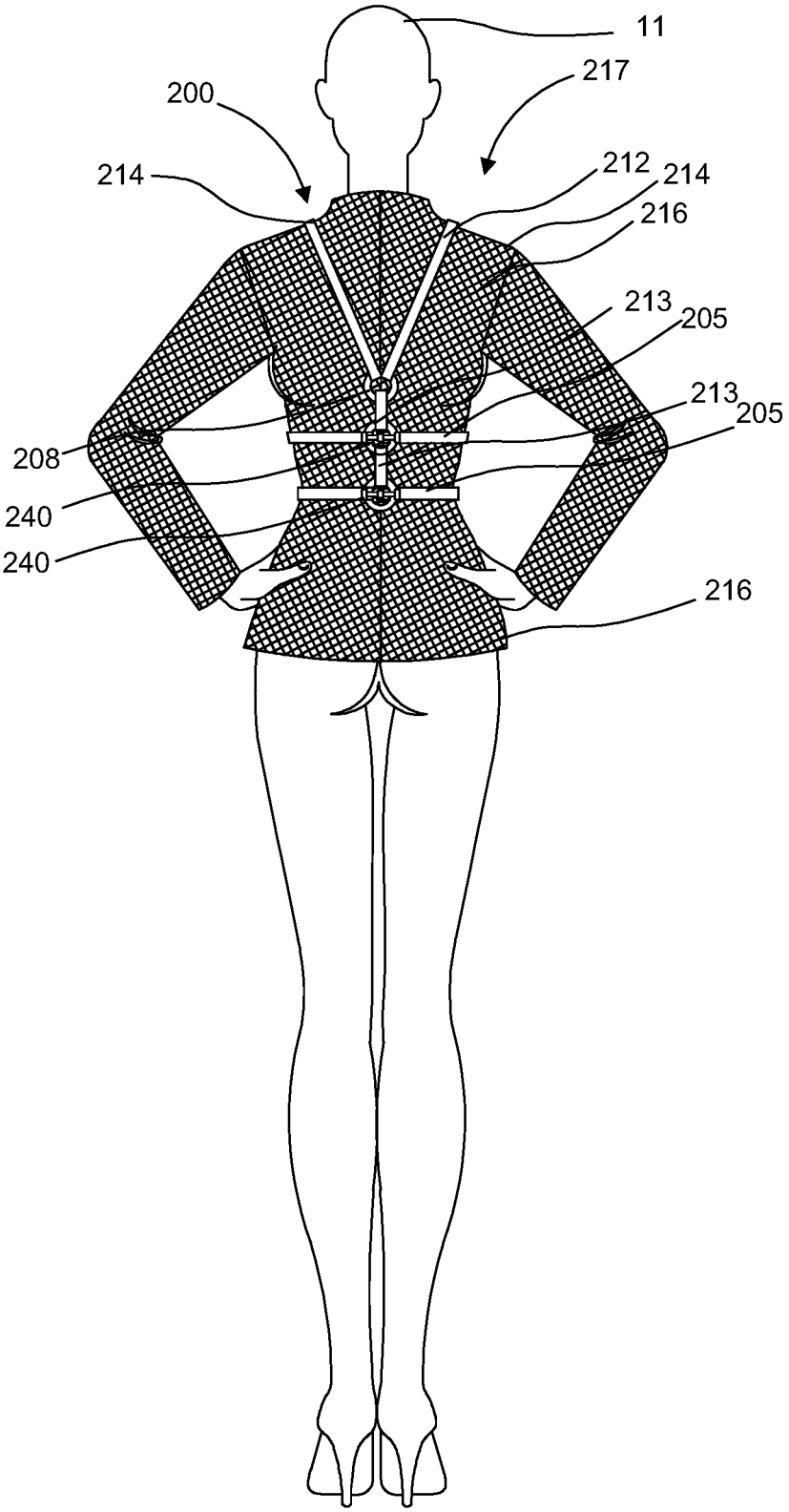
FIG. 3C is a schematic diagram of a rear view of the convertible jacket shown in FIG. 3A.
Figure 3D:
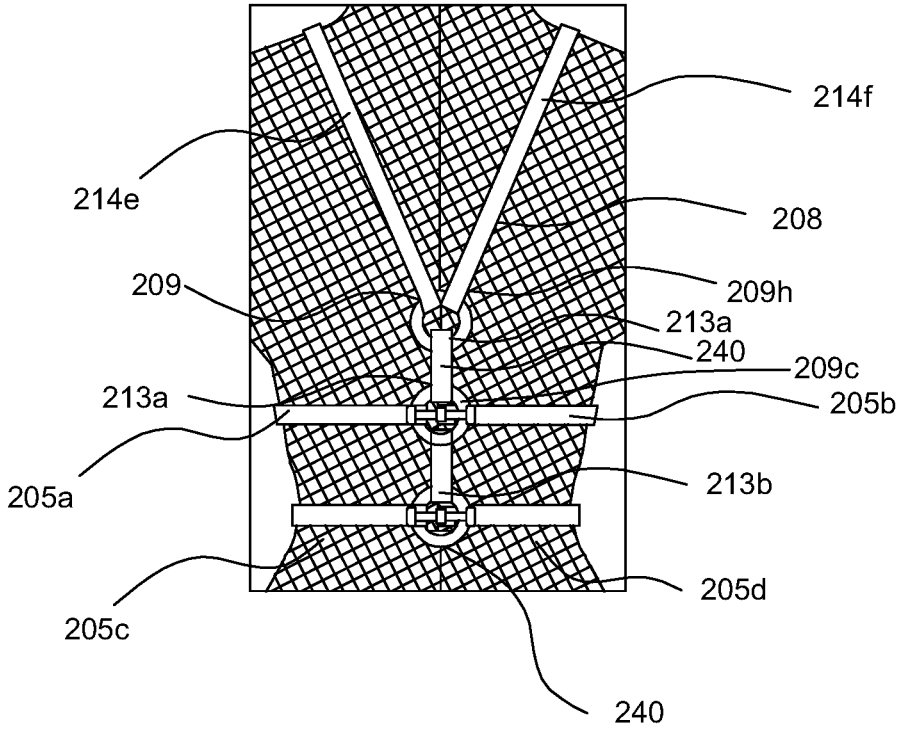
FIG. 3D is a schematic diagram of attachment of straps at the rear of the convertible jacket using an O-ring and toggle closure device.

FIG. 3C illustrates rear 217 of convertible jacket 200. In one embodiment, a plurality of diagonal straps 214*e*-214*f* are coupled to vertical strap 213*a* using ring 208. Each of diagonal straps 214*e*-214*f* and vertical strap 213 include a respective loop 209*g*-209*i* which extends around ring 108. Plurality of horizontal straps 205*a* and 205*b* are coupled to vertical strap 213*a* and vertical strap 213*b* using closure device 240. Plurality of horizontal straps 205*c* and 205*d* are coupled to vertical strap 213*b* using closure device 240.

Figure 3E:
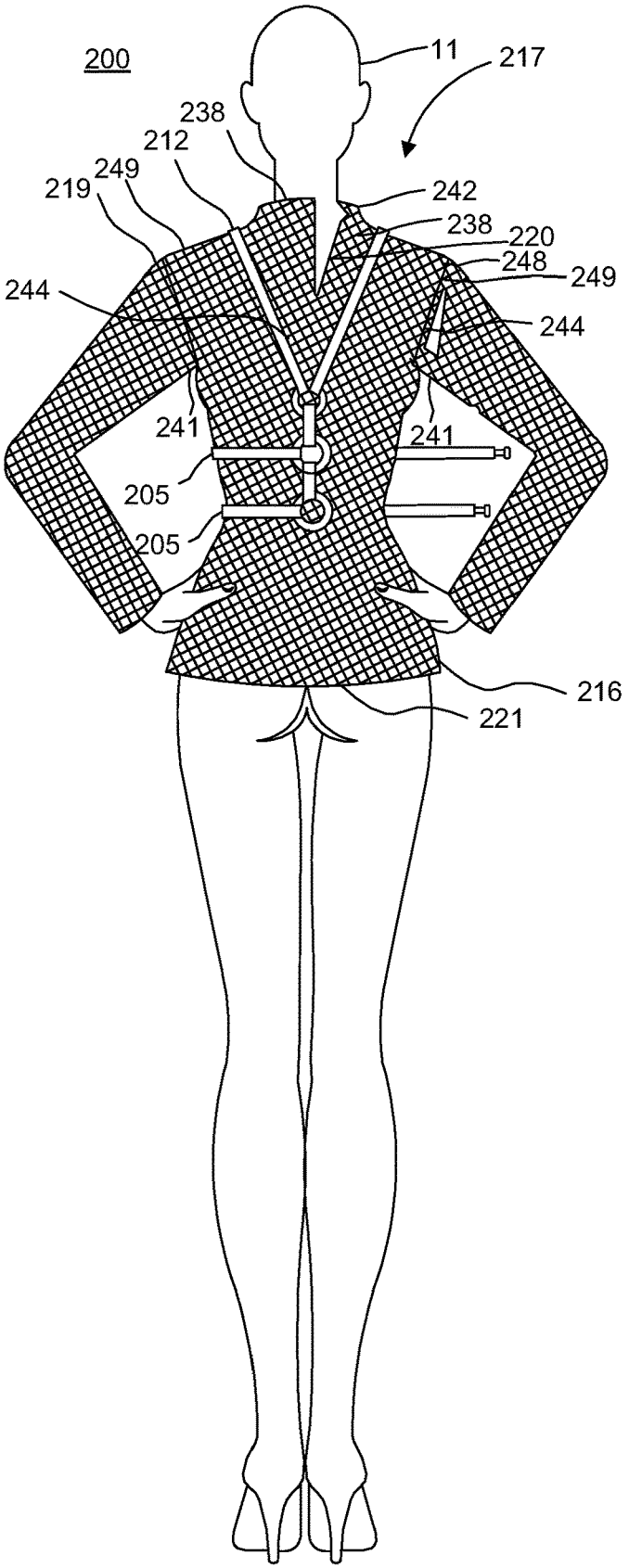
FIG. 3E is a schematic diagram of a rear view of the convertible jacket shown in FIG. 3A in an open position of the O-ring and toggle closure device.

Fastening and release mechanisms 220 are positioned along center 239 of front 215, center 242 of rear 217 and armholes 219 of sleeves 218 of convertible jacket 200 as shown in FIGS. 3A and 3E. Fastening and release mechanisms 220 release under base layer 216 from outer layer 212 fastening and release mechanisms 220 can be used to expeditiously detach under base layer 216 from outer layer 212 without the need for the user to manipulate outer layer 212. Grommets 222 can be positioned at end 224 of sleeve 219. Grommets 222 can be strategically positioned to facilitate bondage.

Fastening and release mechanisms 220 can comprise zipper closure 244. Zipper closures can be hidden. Zipper closure 244 positioned at center 239 of front 217 extends from top of bust 245 to a position 246 below waistline 223 as shown in FIG. 3A. For, example position 246 can be three inches below the waistline 223. Zipper closure 244 at center 239 can zip down from top of bust 245. Zipper closure 244 positioned at center 242 of rear 217 extends between collar 238 and hem 221 of under base layer 216 FIG. 3E. Zipper closure 244 at center 242 can zip down from collar 238. Zipper closure 244 positioned at armholes 219 of sleeves 218 extends from bottom 241 of arm hole 219 to zip up arm hole 219 along forward facing seam 247 over and around shoulder 248 and down rear facing seam 249 back to bottom 241 of arm hole 219 to allow sleeve 218 to be attached and detached as shown in FIG. 3A and FIG. 3E.

Figure 3F:
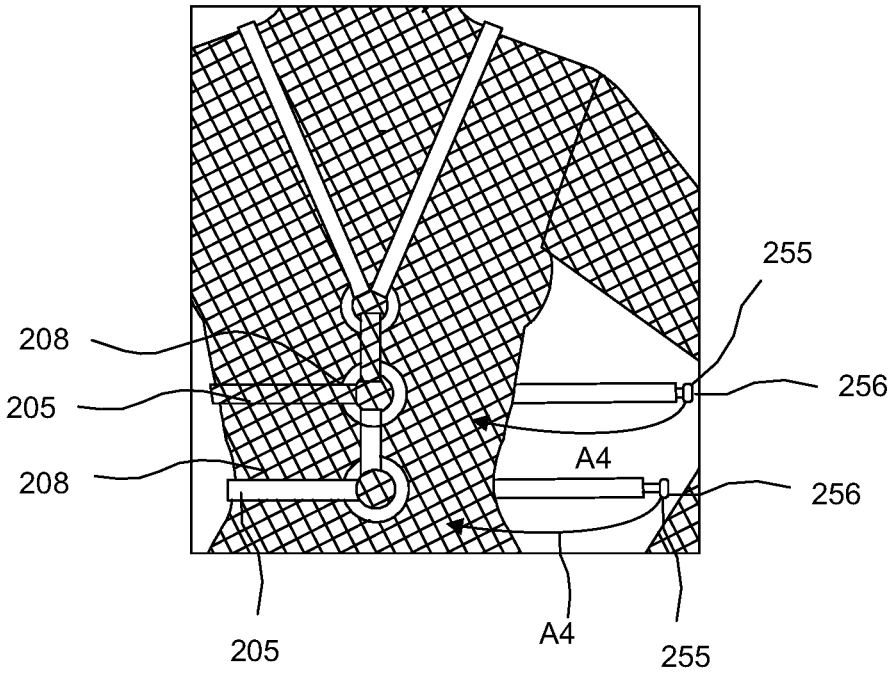
FIG. 3F is a schematic diagram of straps at the rear of the convertible jacket in an open position of the O-ring and toggle closure device.
Figure 3G:
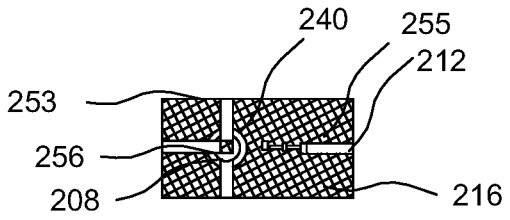
FIG. 3G is a schematic diagram of a closure device including a O-ring and a toggle in an open position.
Figure 3H:
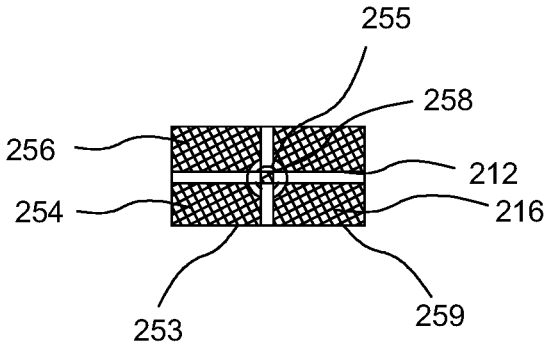
FIG. 3H is a schematic diagram of a closure device including a O-ring and a toggle in a closed position.
Figure 3I:
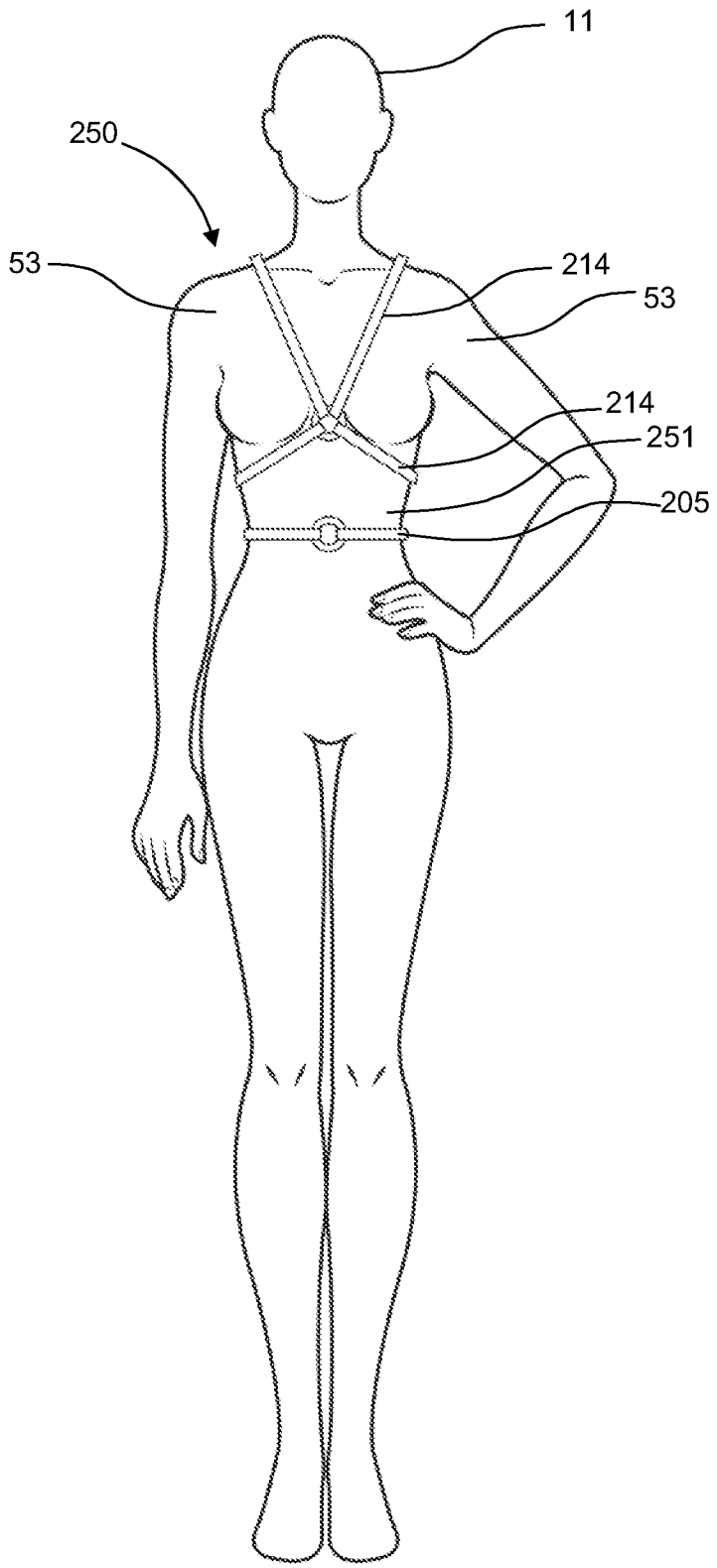
FIG. 3I is a schematic diagram of a front view of a harness shown in FIG. 3A upon removal of an under jacket base layer.
Figure 3J:
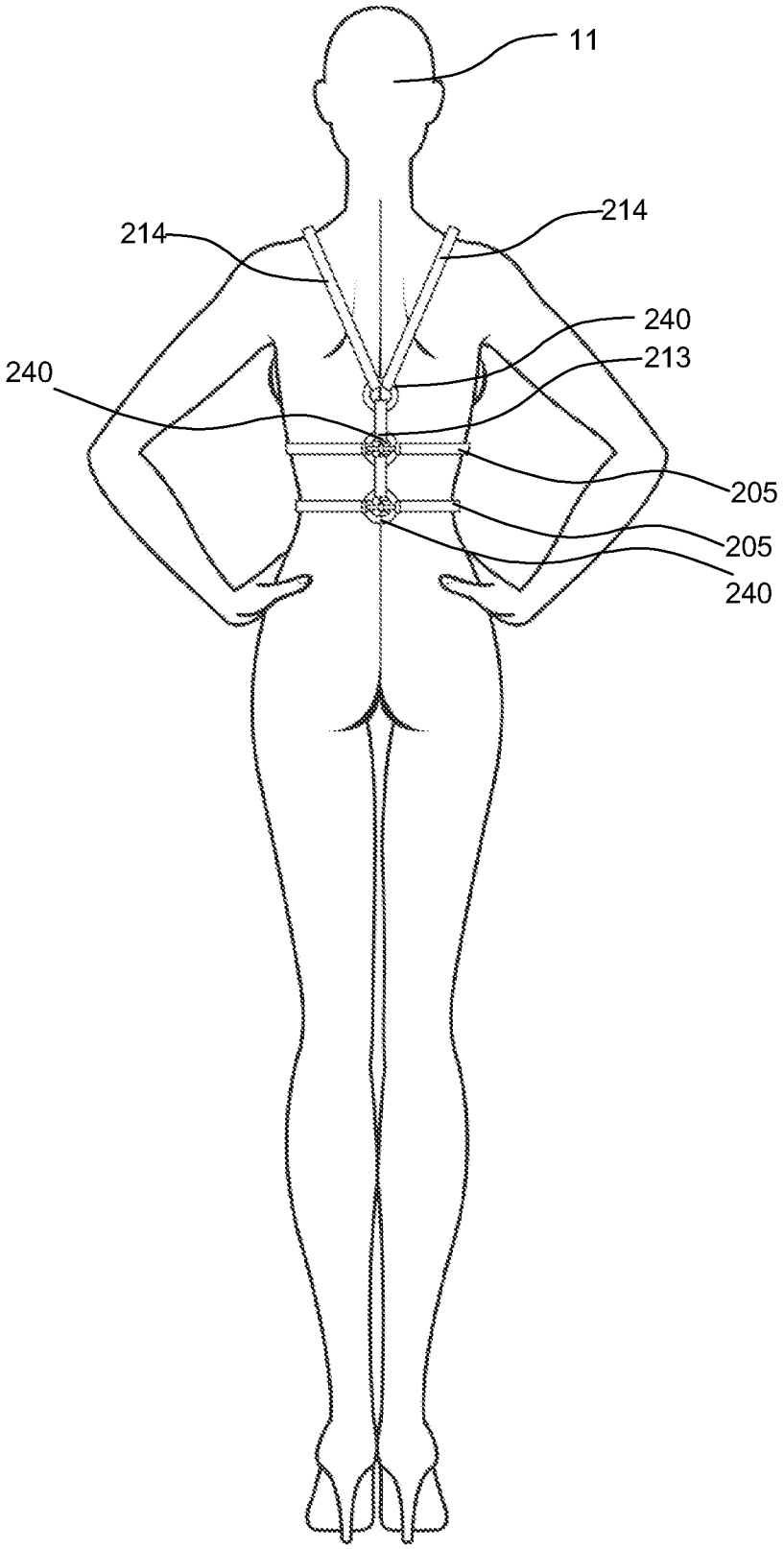
FIG. 3J is a schematic diagram of a rear view of the convertible jacket shown in FIG. 3A upon removal of an under jacket base layer.

Referring to FIG. 3E, closure devices 240 can be formed at rear 217 of convertible jacket 200. Closure devices 240 can be positioned along vertical strap 213 located at center 242. Closure devices 240 can toggle between an open and closed position. Closure devices 240 can be formed of ring 208, ring opening 253, and toggle 255. In an open position as shown in FIG. 3E-3G, toggle 255 is removed from ring opening 253 to open outer layer 212. End 256 moves in the direction of arrow A4 for closing closure device 240. In a closed position as shown in FIG. 3H, toggle 255 is received in ring opening 253 to attach outer layer 112. End 256 of toggle 255 is received in ring opening 253. End 256 of toggle 255 extends over side 257 of ring 208. End 258 of toggle 255 extends over side 259 of ring 208.

Referring to FIG. 3A and FIG. 3C, during operation, convertible jacket 200 is converted between the combination of outer layer 212 and under base layer 216 into outer layer 212 forming restraint 250. Under base layer 216 is disengaged from outer layer 212 by disengaging each of fastening and release mechanisms 220. Right half 260 of convertible jacket can be separated from left half 262 of convertible jacket by unzipping zipper closure 244 positioned at center 239 of front 217, zipper closure 244 positioned at center 242 of rear 217 and zipper closure 244 positioned at armholes 219. Once right half 260 is detached from left half 262 and sleeves are 218 are detached, under base layer 216 can slide out from under outer layer 212.

FIGS. 3G and 3H illustrate outer layer 212 after removal of under base layer 216. Outer layer 212 forms restraint 250 for retaining torso 51 and portions of torso 51 in a predetermined position. The position can be determined for sexual interest or bondage.

FIGS. 4A-4L illustrate an embodiment of clothing 9 of convertible skirt 300 in accordance with the teachings of the present invention. Outer layer 312 is formed of a plurality of vertical straps 313 and a plurality of horizontal straps 314. Each of vertical straps 313 can be formed of one or more sections which are coupled or integral with each other and one or more sections of horizontal straps 314. Under base layer 316 is positioned beneath outer layer 312.

Outer layer 312 can be formed of rigid material. Suitable materials for outer layer 312 include a mesh of material with sufficient tensile strength to serve as a restraining element. In one embodiment, outer layer 312 can be formed of leather. Alternatively, outer layer 312 can be formed of poly elastane.

Under base layer 316 can be formed of a flexible material. Under base layer 316 can be formed of flexible or soft fabric materials. Suitable materials for under base layer 316 include polyester, cotton, polyester and cotton combinations, elastane synthetic fiber, cotton and elastane synthetic fiber combinations and silk jersey. Elastane synthetic fiber can include spandex including LYCRA® as manufactured by Dupont. Under base layer 316 protects skin of user 11 from undesired friction of outer layer 312.

Figure 4A:
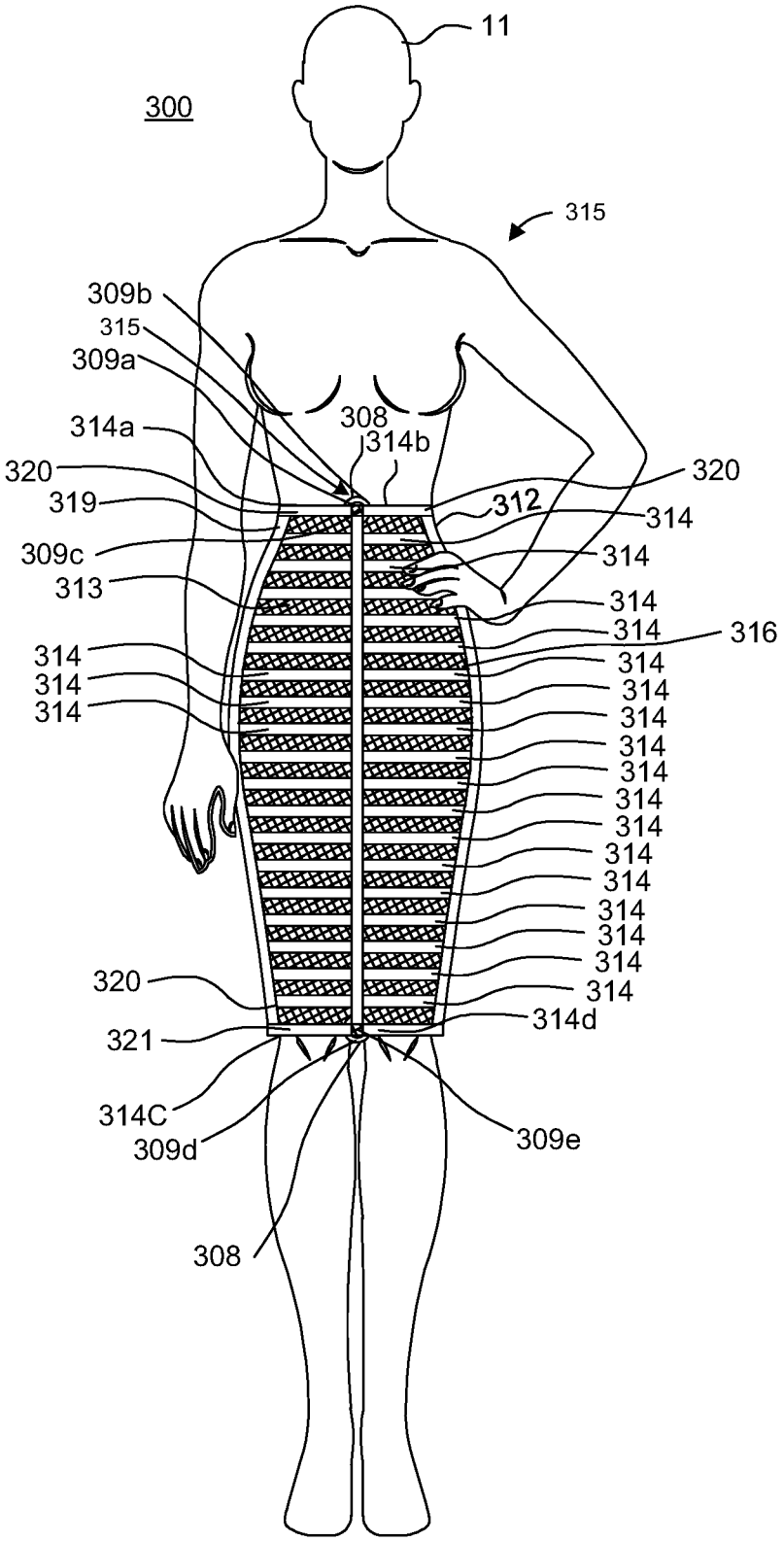
FIG. 4A is a schematic diagram of a front view of a convertible skirt in accordance with the teachings of the present invention.
Figure 4B:
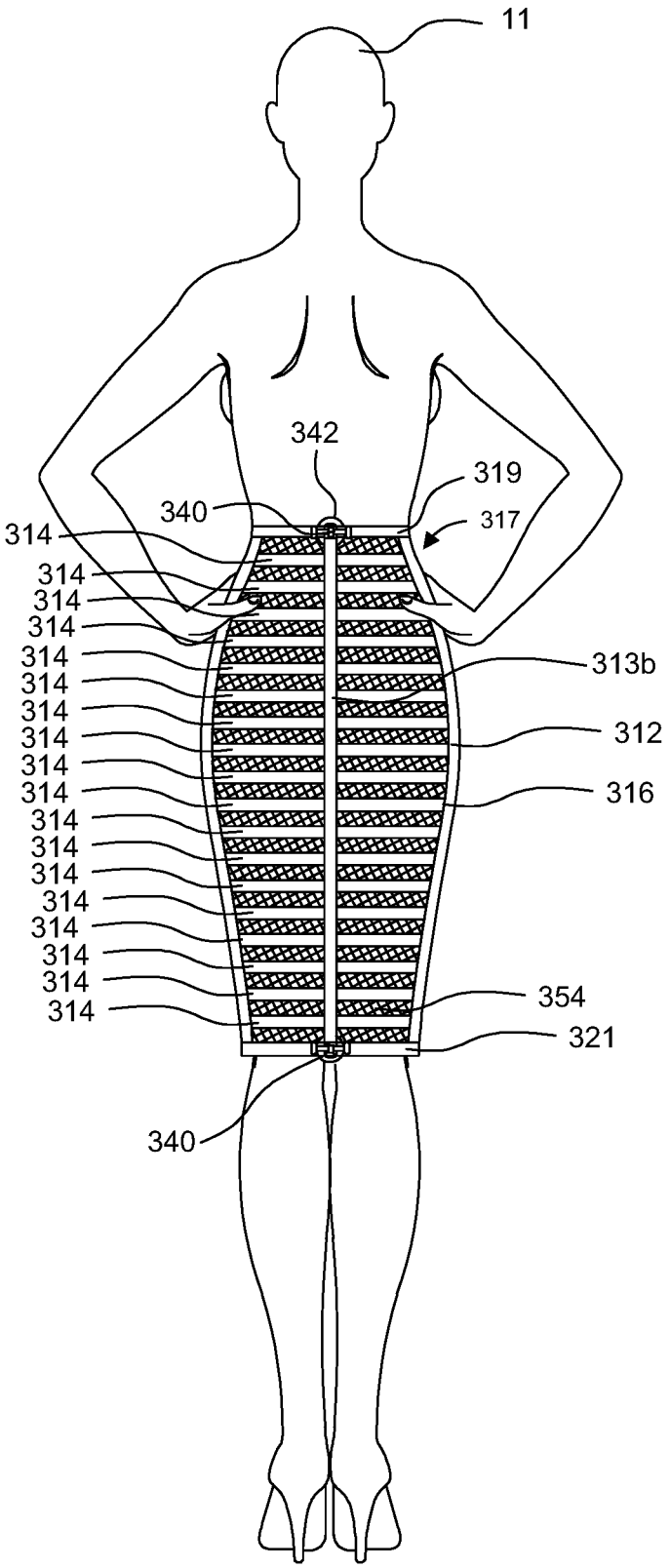
FIG. 4B is a schematic diagram of a rear view of the convertible skirt shown in FIG. 4A.

FIG. 4A illustrates front 315 of convertible skirt 300. FIG. 4B illustrates rear 317 of convertible skirt 300. In one embodiment, a plurality of horizontal straps 314*a*, 314*b* at front 315 can be coupled to one another and vertical strap 313*a* using ring 308 forming waistband 319. Each of horizontal straps 314*a*-314*b* and vertical strap 313*a* include a respective loop 309*a*-309*c* which extends around ring 308. Vertical strap 313*a* extends from ring 308 at waistband 319 to ring 308 at hem 321. Plurality of horizontal straps 314*c*, 314*d* at front 315 can be coupled to one another and vertical strap 313*a* using ring 308 forming hem 321. Each of horizontal straps 314*c*-314*d* and vertical strap 313*a* include a respective loop 309*d*-309*f* which extends around ring 308.

Fastening and release mechanisms 320 are positioned along hem 321 and waistband 319 of convertible skirt 300. Fastening and release mechanisms 320 releasably couple under base layer 316 to outer layer 312 Fastening and release mechanisms 320 can be used to expeditiously detach under base layer 316 from outer layer 312 without the need for the user to manipulate outer layer 312.

Figure 4C:
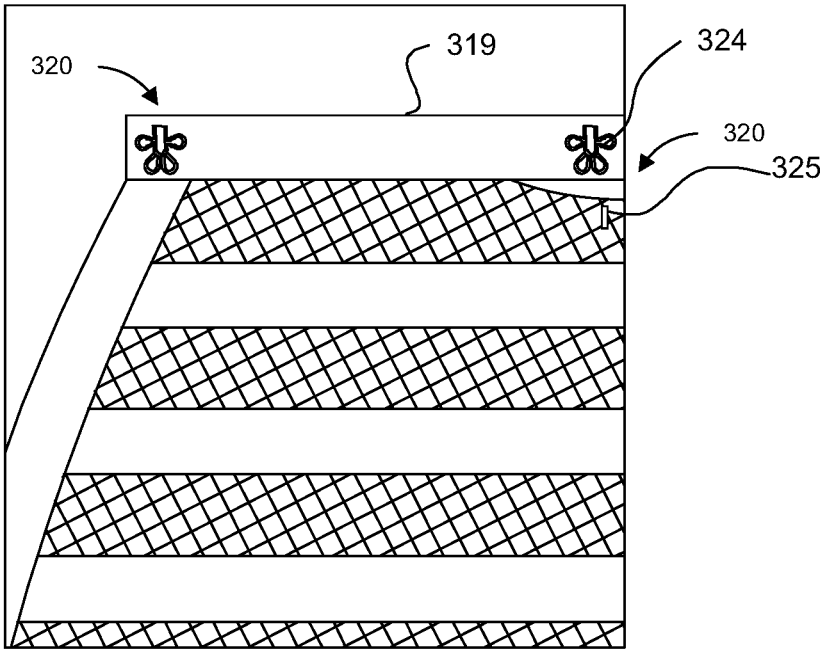
FIG. 4C is a schematic diagram of an embodiment of a skirt fastening and release mechanism including a hook and eye coupling used with the convertible skirt shown in FIG. 4A.

FIG. 4C illustrates an embodiment of fastening and release mechanism 320 shown attached to waistband 319. Fastening and release mechanism 320 includes hook coupling member 324 attached to outer layer 312 and eye coupling member 325 attached to under base layer 316 for coupling under base layer 316 to outer layer 312. Hook coupling member 324 is disengaged from eye coupling member 325 to decouple under base layer 316 from outer layer 312. Suitable materials for hook coupling member 324 and eye coupling member 325 include plastic or metal.

Figure 4D:
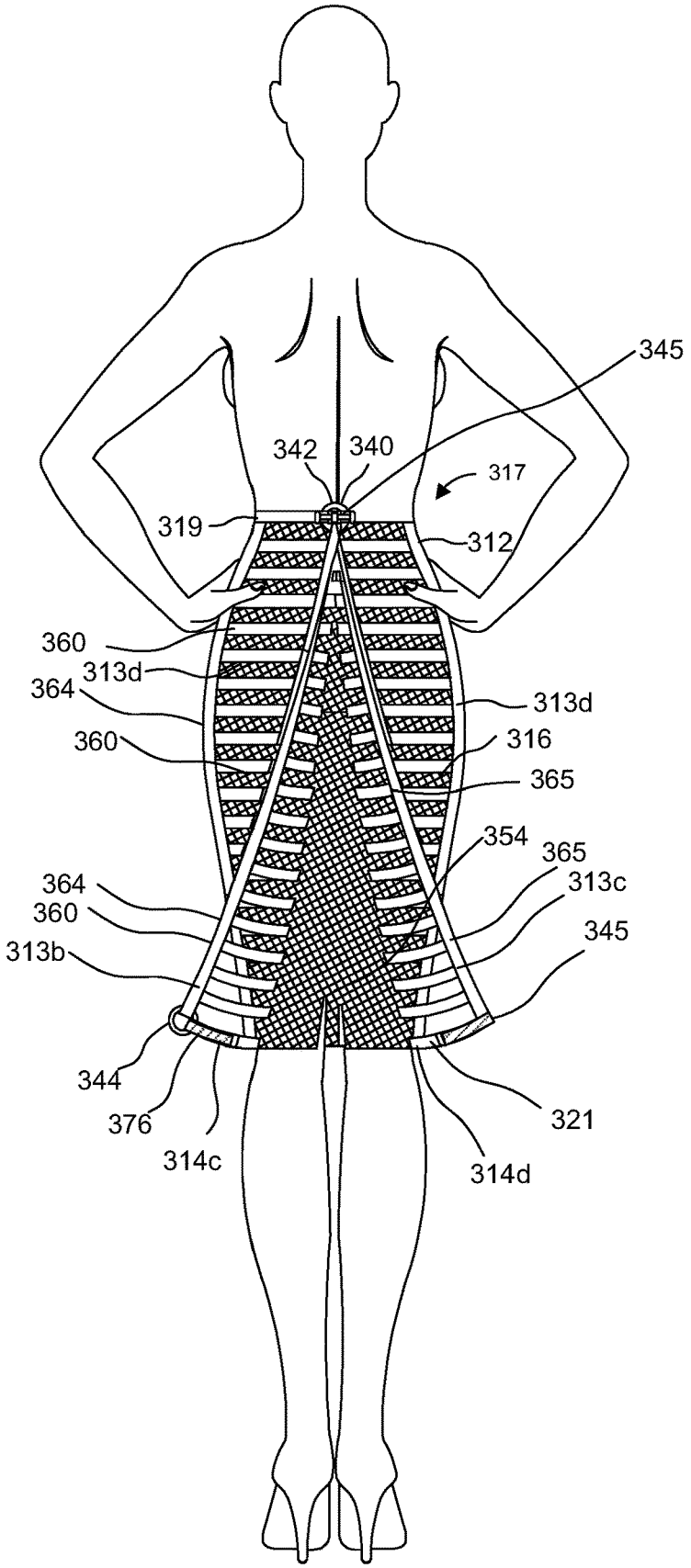
FIG. 4D is a schematic diagram of a rear view of the convertible skirt shown in FIG. 4A in an open position of a O-ring and toggle closure device.
Figure 4E:
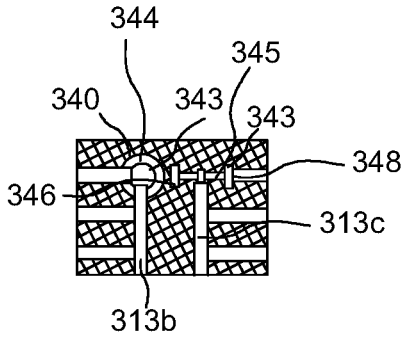
FIG. 4E is a schematic diagram of a closure device including a O-ring and a toggle in an open position.
Figure 4F:
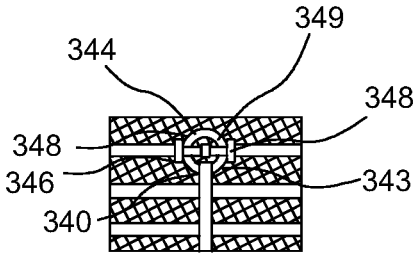
FIG. 4F is a schematic diagram of a closure device including a O-ring and a toggle in a closed position.

Referring to FIGS. 4B and 4D, closure devices 340 can be formed at rear 317 of convertible skirt 300. Closure devices 340 can be positioned at waistband 319 and hem 321. Closure devices 340 can be moved between an open and closed position. Closure devices 340 can be formed of ring opening 343, ring 344 and toggle 345 as shown in FIGS. 4E-4F. Ring 344 can be an O-ring. Ring 344 is attached to vertical strap 313*b* and toggle 345 is attached to vertical strap 313*c* as shown in FIG. 4D. In an open position as shown in FIG. 4E, toggle 345 is removed from ring opening 343 to open outer layer 312. In a closed position as shown in FIG. 4F, toggle 345 is received in ring opening 343 to attach outer layer 312. End 346 of toggle 345 is received in ring opening 343. End 346 of toggle 345 extends over side 347 of ring 344. End 348 of toggle 345 extends over side 349 of ring 344.

Referring to FIG. 4D, zipper closure 354 extends between waistband 319 and hem 321 of under base layer 316 at center 342. Zipper closure 354 is used for opening and closing under base layer 316. Zipper closure 354 can be unzipped to open under base layer 16 between hem 321 and waistband 319. Fastening and release mechanisms 360 includes hook coupling member 364 attached to vertical strap 313*b* of outer layer 312 and eye coupling member 365 attached to vertical strap 313*c* of outer layer 312 for coupling vertical strap 313*b* to vertical strap 313*c*. Hook coupling member 364 is disengaged from eye coupling member 365 to decouple vertical strap 313*b* from vertical strap 313*c*. Suitable materials for hook coupling member 364 and eye coupling member 365 include plastic or metal. Referring to FIG. 4B, when fastening and release mechanisms 360 are closed, zipper closure 354 extends underneath vertical strap 313*b* located at center 342. Zipper closure 354 can be hidden by vertical strap 313.

Figure 4G:
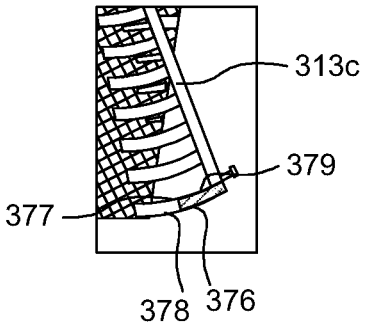
FIG. 4G is a schematic diagram of strap for holding a bottom of the convertible skirt open, the strap being in a closed position.
Figure 4H:
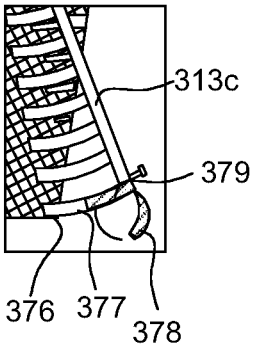
FIG. 4H is a schematic diagram of strap for holding a bottom of the convertible skirt open, the strap being in an open position.
Figure 4I:
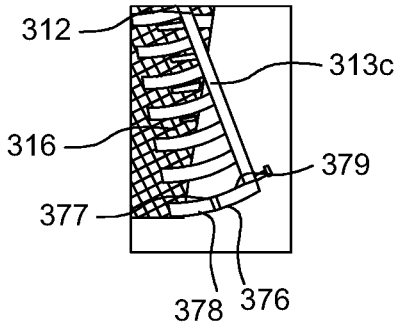
FIG. 4I is a schematic diagram of strap for holding a bottom of the convertible skirt open, the strap being in an open position and being moved toward a vertical side strap.
Figure 4J:
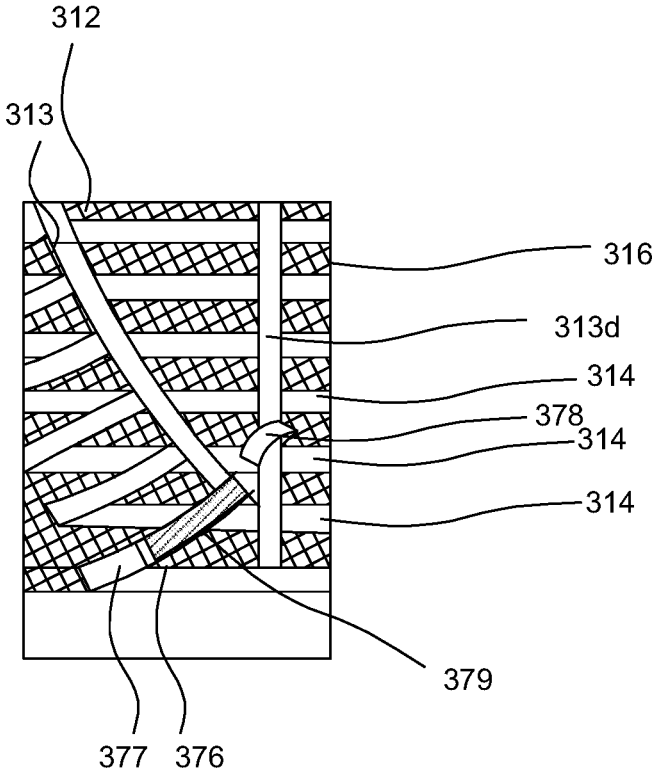
FIG. 4J is a schematic diagram of side view of the strap for holding a bottom of the convertible skirt open, the strap being positioned around the vertical side strap of the outer layer.
Figure 4K:
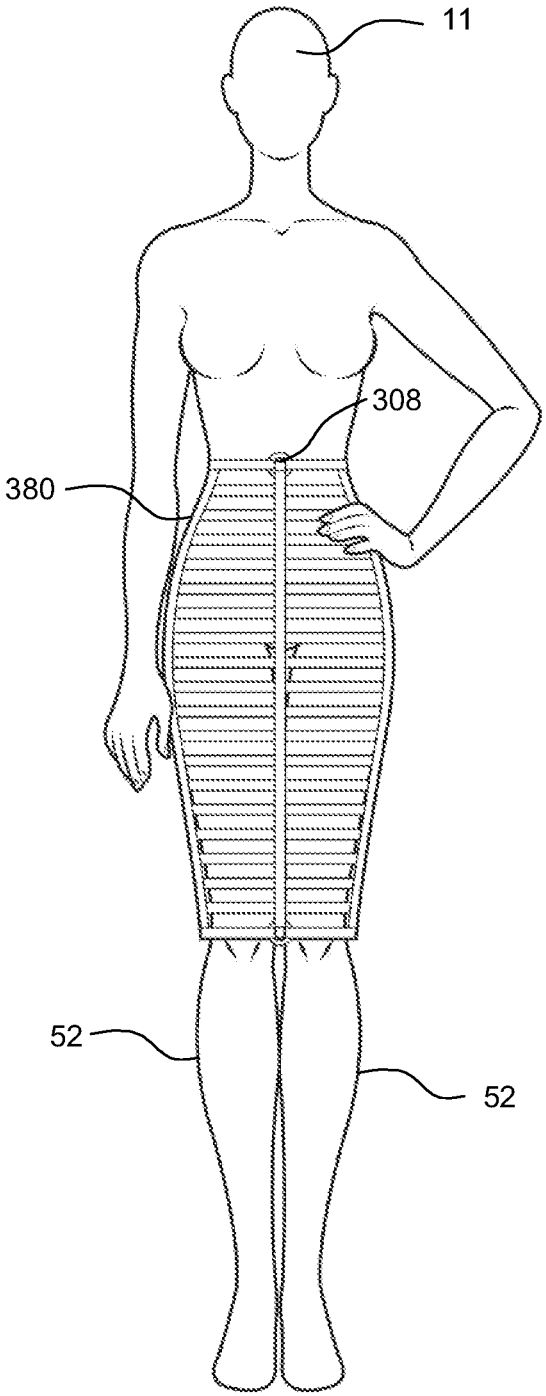
FIG. 4K is a schematic diagram of a front view of the convertible skirt shown in FIG. 4A upon removal of an under skirt base layer.
Figure 4L:
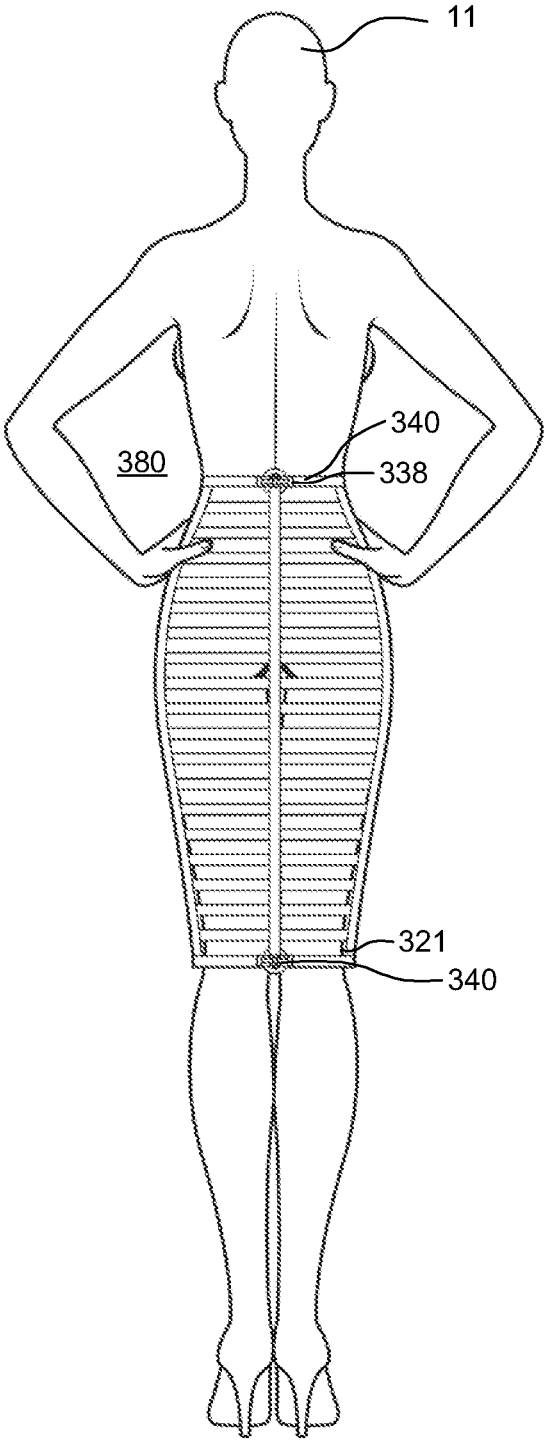
FIG. 4L is a schematic diagram of a rear view of the convertible skirt shown in FIG. 4A upon removal of an under skirt base layer.

Referring to FIG. 4D, and FIGS. 4G-4J, straps 376 can be positioned on horizontal straps 314*c,d* of outer layer 312 at hem 321. Straps 376 can be formed of a hook and loop material such as VELCRO. Straps 376 can be coupled to outer layer 312 by sewing. Strap 376 includes end portion 377 and end portion 378. End portion 378 of strap 376 is attached to base portion 379 of strap 376 in a closed position as shown in FIG. 4G. In the closed position, strap 376 can be hidden by hem 321. End portion 378 of strap 376 is released from base portion 379 of strap 376 in an open position, as shown in FIG. 4H. End portion 378 is moved around vertical strap 313*d* at a side of convertible skirt 300 as shown in FIG. 4I. End portion 378 wraps around vertical strap 313*d* and end portion 378 can connect to base portion 379 as shown in FIG. 4J. Straps 376 in the open position can be used to hold outer layer 312 open when closure device 340 at hem 321 is in an open position. FIGS. 4K and 4L illustrate outer layer 312 after removal of under base layer 316. Outer layer 312 forms cage 380 for retaining legs 52 in a predetermined position. The position can be determined for sexual interest or bondage.

During operation, convertible skirt 300 is converted between the combination of outer layer 312 and under base layer 316 into outer layer 312 forming cage 380. Under base layer 316 is disengaged from outer layer 312 by disengaging hook coupling member 324 from eye coupling member 325 of each of fastening and release mechanisms 320. Rear 317 of convertible skirt 300 can be opened partially or fully by opening closure devices 340 and zipper closure 354 for removing under base layer 316 from outer layer 312.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

The invention claimed is:

1. An apparatus to convert clothing comprising:

an outer layer;

an under base layer; and at least one fastening and release mechanism for coupling the under base layer to the outer layer and removal of the under base layer from the outer layer, the clothing is a convertible skirt the outer layer is formed of a plurality of vertical straps and a plurality of horizontal straps, each of the vertical straps extending vertically, each of the horizontal straps extending horizontally, each of the vertical straps being coupled or integral with the plurality of horizontal straps, a top one of the horizontal straps being a waistband and a bottom one of the horizontal straps being a hem wherein the fastening and release mechanisms are positioned at the hem and the waistband of the outer layer and a hem and a waistband of the under base layer of the convertible skirt, the fastening and release mechanisms comprising hook coupling members and eye coupling members, a first set of the hook coupling members coupled to an underside of the hem of the outer layer, a second set of the hook coupling members coupled to an underside of the waistband of the outer layer, a third set of the hook coupling members coupled to one of the vertical straps of the outer layer positioned at sides of the convertible skirt, the eye coupling members attached to the hem and the waistband and sides of the under base layer, the hook coupling members configured for being received in the eye coupling members for coupling the under base layer to the outer layer and the hook coupling members are disengaged from the eye coupling members to decouple the under base layer from the outer layer, wherein the top one of the horizontal straps comprising a pair of horizontal straps and the bottom one of the horizontal straps comprising a pair of horizontal straps and further comprising closure devices formed at a center at a rear of the convertible skirt, a first of the closure devices connecting the pair of the horizontal straps of the bottom one at the hem and a second of the closure devices connecting the pair of the horizontal straps of the top one at the waistband, the closure devices formed of a ring having a ring opening therein and a toggle, the toggle is removed from the ring opening to open the outer layer and the toggle is received in the ring opening and ends of the toggle extend over sides of the ring to close the outer layer wherein the release mechanisms detach the under base layer from the outer layer and when the under base layer is decoupled from the outer layer the clothing is transformed into sexual paraphernalia.

2. The apparatus of claim 1 wherein the outer layer is formed of a material selected from mesh, leather or poly elastane.

3. The apparatus of claim 1 wherein the under base layer is formed of a flexible material of flexible or soft fabric materials of polyester, cotton, polyester and cotton combinations, elastane synthetic fiber, cotton, elastane synthetic fiber combinations or silk jersey.

4. The apparatus of claim 1 further comprising a plurality of straps attached to the outer layer at the hem, the straps including a base portion, the base portion having a first end and a second end, the first end of the base portion being attached to the outer layer at the hem, said straps being formed of a hook and loop material, in a closed position said straps being hidden by the hem and in an open position the second end of the straps being moved around one of the verticals straps positioned at a side of the convertible skirt, the straps hold the outer layer open when the toggle is removed from the ring opening at the hem of the convertible skirt.

5. An apparatus to convert clothing comprising:

an outer layer;

an under base layer; and at least one fastening and release mechanism for coupling the under base layer to the outer layer and removal of the under base layer from the outer layer, the clothing is a convertible skirt the outer layer is formed of a plurality of vertical straps and a plurality of horizontal straps, each of the vertical straps extending vertically over each of the horizontal straps extending horizontally, each of the vertical straps being coupled or integral with the plurality of horizontal straps, a top one of the horizontal straps being a waistband and a bottom one of the horizontal straps being a hem wherein the fastening and release mechanisms are positioned at the hem and the waistband of the outer layer and a hem and a waistband of the under base layer of the convertible skirt, the fastening and release mechanisms comprising hook coupling members and eye coupling members, a first set of the hook coupling members coupled to an underside of the hem of the outer layer, a second set of the hook coupling members coupled to an underside of the waistband of the outer layer, a third set of the hook coupling members coupled to one of the vertical straps of the outer layer positioned at sides of the convertible skirt, the eye coupling members attached to the hem and the waistband and sides of the under base layer, the hook coupling members configured for being received in the eye coupling members for coupling the under base layer to the outer layer and the hook coupling members are disengaged from the eye coupling members to decouple the under base layer from the outer layer and a zipper closure extending underneath one of the vertical straps located at a center of a rear of the convertible skirt said zipper closure extends between the waistband and the hem of the under base layer, the zipper closure configured to be unzipped to open the under base layer.

6. An apparatus to convert clothing comprising:

the clothing is a convertible skirt, an outer layer;

an under base layer; and at least one fastening and release mechanism for coupling the under base layer to the outer layer and removal of the under base layer from the outer layer, wherein the fastening and release mechanisms are positioned at a hem and a waistband of the outer layer and the under base layer of the convertible skirt, and further comprising a zipper closure located at center of a rear of the convertible skirt, said zipper closure extends between the waistband and the hem of the under base layer, the zipper closure configured to be unzipped to open the under base layer, and further comprising a plurality of straps attached to the outer layer at the hem, one or more closure devices formed at the center at the rear of the convertible skirt connecting the outer layer at the hem, the plurality of straps including a base portion, the base portion having a first end and a second end, the first end of the base portion being attached to the outer layer at the hem, said straps being formed of a hook and loop material, in a closed position said straps being hidden by the hem and in an open position the straps hold the outer layer open and wherein the at least one fastening and release mechanisms detach the under base layer from the outer layer without the need to manipulate the outer layer to decouple the under base layer from the outer layer and when the under base layer is decoupled from the outer layer the clothing is transformed into sexual paraphernalia.

* * * * *